United States Patent [19]

Eldridge

[11] 4,028,813

[45] June 14, 1977

[54] SUN COMPASS

[76] Inventor: Albert M. Eldridge, 4711 Chiaperro Trail, Austin, Tex. 78731

[22] Filed: Oct. 22, 1975

[21] Appl. No.: 624,904

Related U.S. Application Data

[63] Continuation-in-part of Ser. No. 577,176, May 14, 1975, abandoned.

[52] U.S. Cl. ..... 33/270

[51] Int. Cl.[2] ..... G04B 49/02; G04B 49/04

[58] Field of Search ..... 33/270, 271

[56] References Cited

UNITED STATES PATENTS

| | | | |
|---|---|---|---|
| 281,527 | 7/1883 | Larsen | 33/270 |
| 303,118 | 8/1884 | Christian | 33/270 |
| 794,787 | 7/1905 | Crehore | 33/270 |
| 1,674,161 | 6/1928 | DeBogory | 33/270 |
| 2,192,750 | 3/1940 | Mead | 33/270 |
| 3,417,473 | 12/1968 | Troseth | 33/270 |

*Primary Examiner*—Richard E. Aegerter
*Assistant Examiner*—Richard R. Stearns
*Attorney, Agent, or Firm*—Burns, Doane, Swecker & Mathis

[57] ABSTRACT

A sun compass comprises a base, including a transparent hemisphere, a body movable within the base, and a plate including a dial face movable upon the body. Actuating members are connected to the plate and body for selectively moving the plate relative to the body and moving the body relative to the hemisphere. The actuating members are accessible externally of the hemisphere and include rotatable knobs having scales associated therewith for indicating the amount of movement of the plate and body. A transparent hemispherical top is mounted over the base hemisphere.

16 Claims, 34 Drawing Figures

FIG. 2
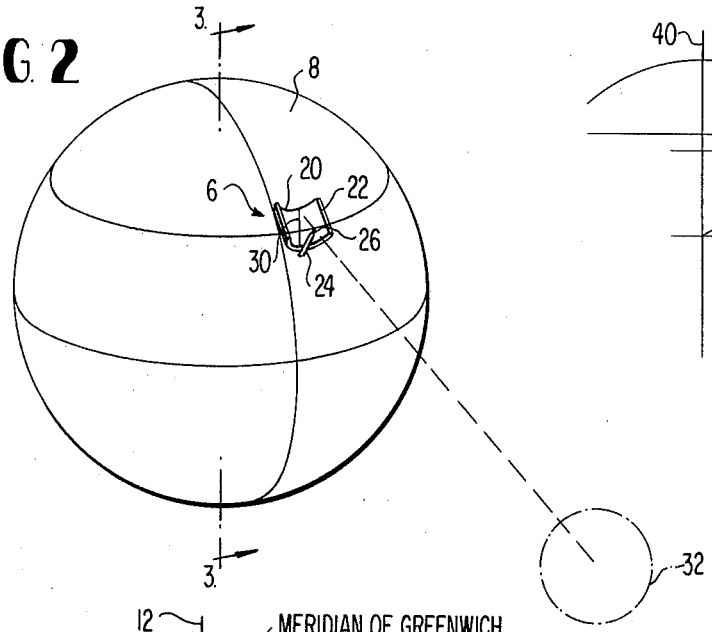
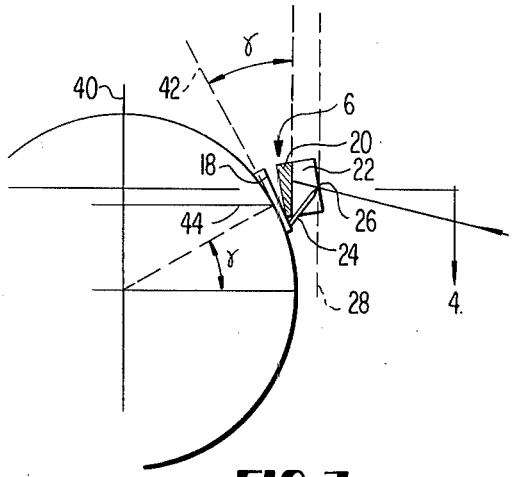
FIG. 3
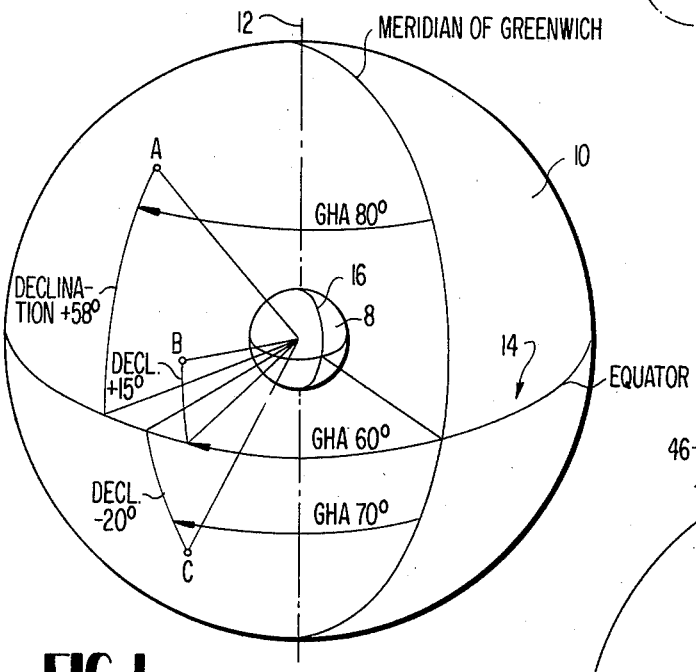
FIG. 1
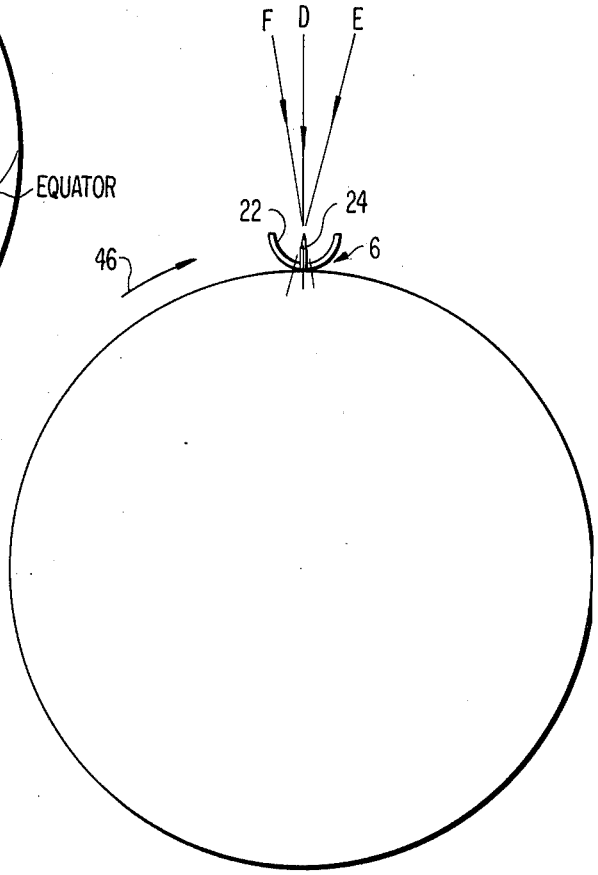
FIG. 4

FIG. 10
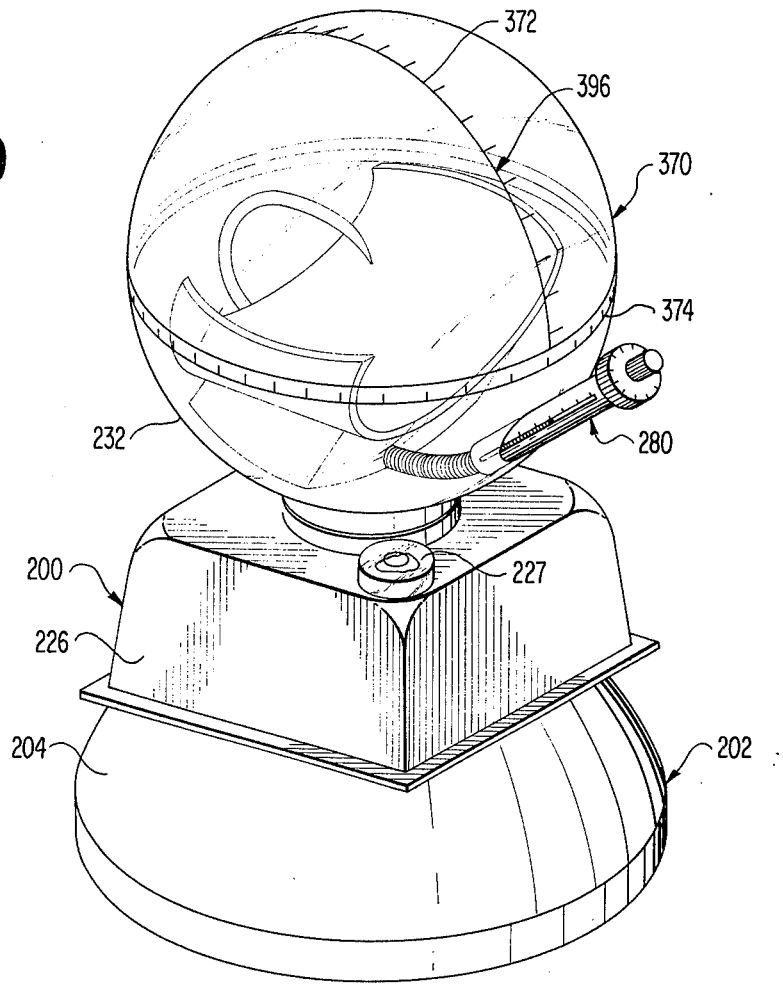
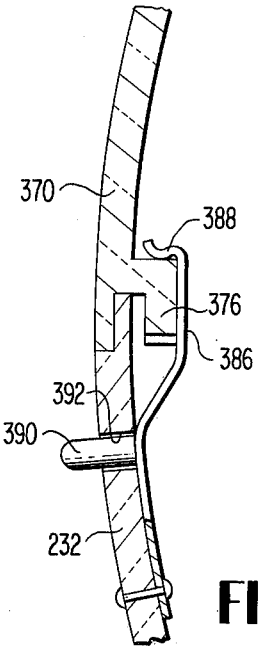
FIG. 11
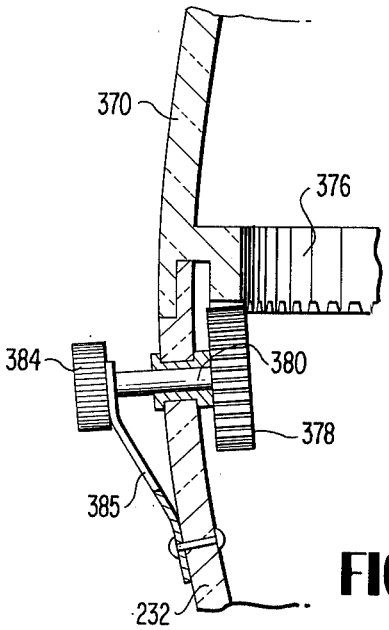
FIG. 12

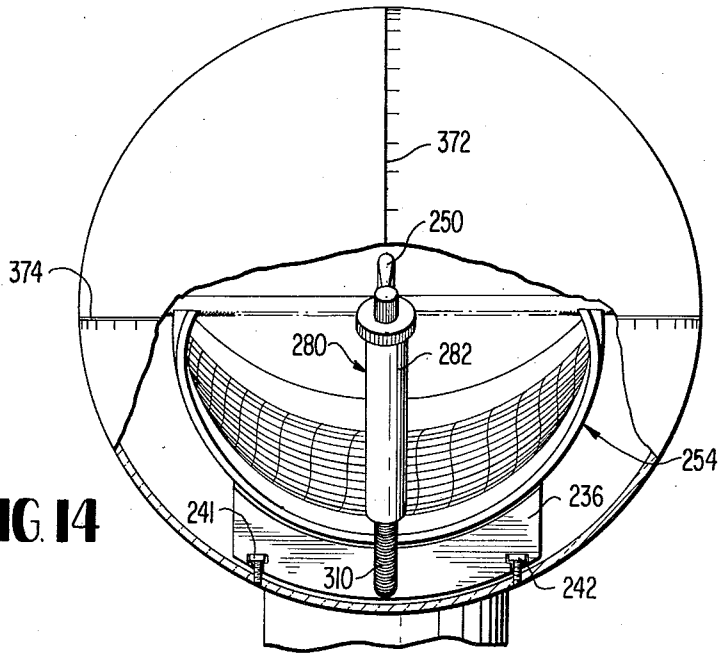
FIG. 14
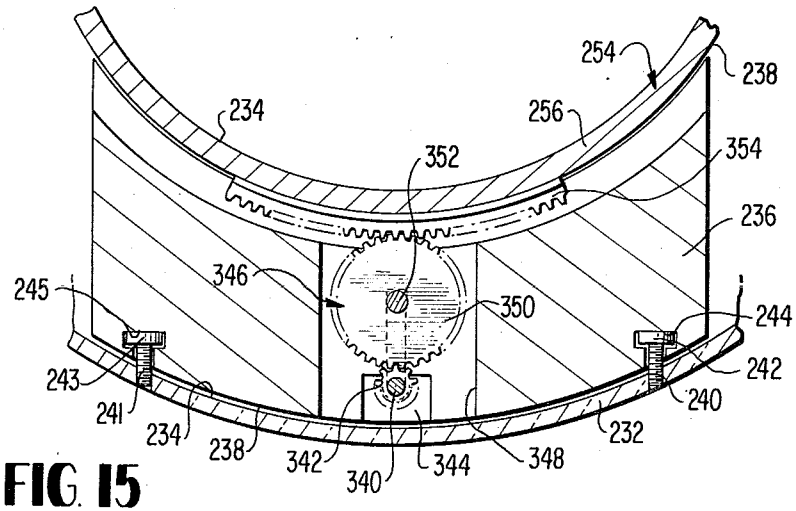
FIG. 15
FIG. 13
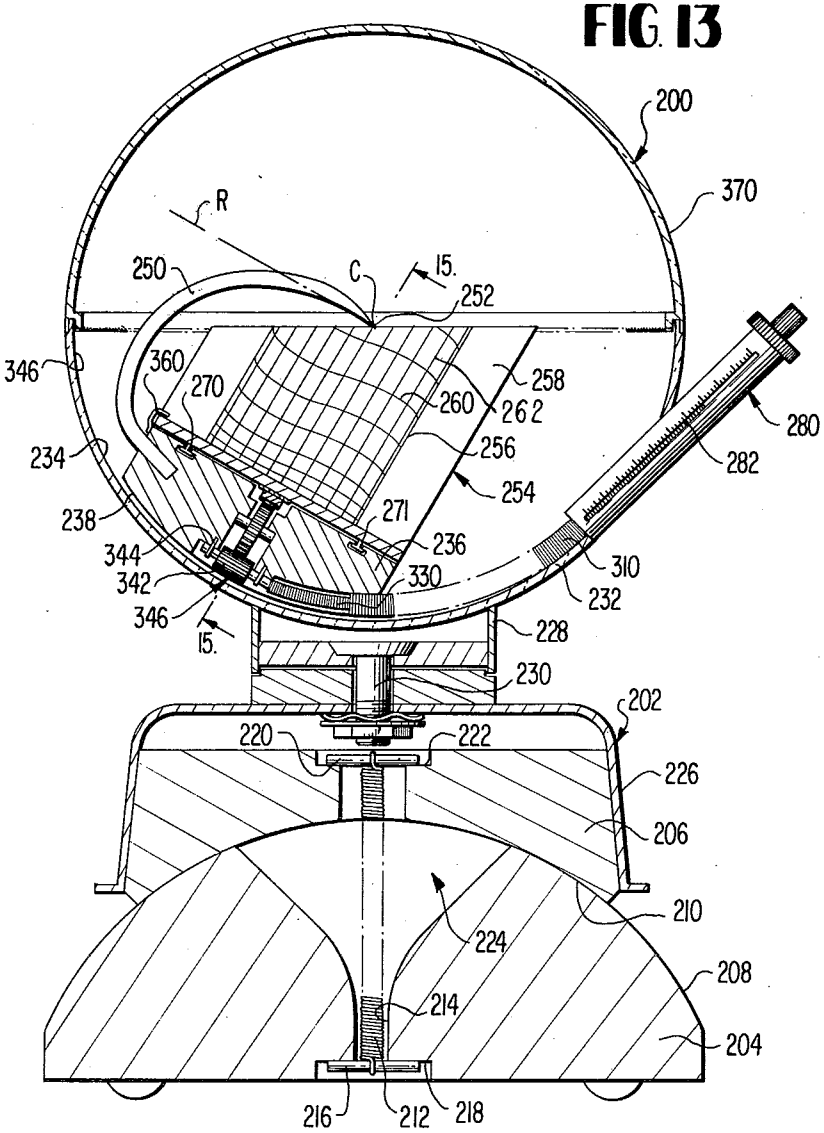

SUN COMPASS

RELATED APPLICATION

This is a continuation-in-part of the inventor's U.S. application Ser. No. 577,176, now abandoned filed May 14, 1975.

BACKGROUND AND OBJECTS OF THE INVENTION

The present invention relates generally to a sun compass which affords an accurate reading of the northern direction when either the time or date is known. More particularly, the invention relates to a sun compass which automatically accommodates variations between the Greenwhich Hour Angle (GHA) of the sum and the Greenwhich Hour Angle of noon Local Civil Time (LCT), and which affords convenient adjustment to adjust for latitude variances as well as differences between Local Civil Time and the standard (or daylight saving) time of the particular zone in which the sun is being observed.

Sundial Background

Man's earliest attempts to define his activities in terms of time involved observations of the movement or position of various heavenly bodies. The Aztecs, Egyptians, and the inhabitants of the area around Stonehenge, for instance, erected various monuments to define the seasons and guide the planting of crops. Successive refinements led to the capability of dividing time into relatively fine increments so that the day could be defined as a series of rather short, discrete intervals of time. With regard to the measurement of time during the daylight hours, the instruments employed ultimately evolved into the well known sundial having a triangular gnomon and a planar face calibrated circularly to read generally in hours and divisions thereof.

Basic problems have always interfered with the use of sandials to define time. In particular, the sundials simply have not afforded an accurate reading of time. One particularly basic problem interfering with the accuracy of sundials is the fact that the earth travels in an elliptical, rather than circular, path around the sun. In actuality, the time at which the sun is overhead may either precede or follow the time at which the sun should be overhead if the earth were traveling in a circular path. In other words, at the time at which the sun should be overhead on the basis of a constant rate of rotation, the sum may in fact be either ahead or behind the actual overhead position. Most sundials of the prior art do not consider this problem and simply indicate noon when the sun is in fact overhead. No consideration is given to the relation between the time which can be read from the sundial and the time given by a mechanical timepiece. The error resulting from the assumption that the earth traveling in a circular path may amount to more than one quarter of an hour on certain days of the year. This problem is most commonly expressed in terms of the Greenwich Hour Angle (GHA) of the sum as compared to the hour angle of noon Local Civil Time (LCT). Using this approach, the problem resides in the fact that the GHA of the sum either exceeds or is less than the GHA of noon LCT.

The matter of accuracy is further complicated by the fact that the degree by which the GHA of the sum exceeds or is less than the GHA of noon LCT varies with the declination of the sum. These problems, i.e., the differences between the GHA of the sun and the GHA of noon LCT and the variations of these differences throughout the year thus cannot be conveniently corrected by mere recalibration of the sundial.

A further problem occurs as a result of the division of the earth into time zones. The United States in particular is divided into Eastern, Central, Mountain, and Western Time zones. The time within each zone is constant by convention and is based upon the time at a standard meridian generally located near the midpoint of each zone. At various points east and west of the zone standard meridian it will actually be later or earlier than the time at the standard meridian. As a result the time as indicated by the sundial does not coincide with that indicated by a mechanical timepiece within the zone. Thus, the sundials of the prior art may involve an error of as much as one-half based simply on differences between the longitude of the standard meridian and the longitude of the particular point of observation of the sun. These sundials further appear incapable of being conveniently and accurately adjusted to remove this inaccuracy.

Other sundials of the prior art pose the rather difficult problem that they are not easily read. Many require a confusing mapping of lines, dates, numbers, and/or multiple scales which must be used collectively to determine the time of any given day. Other sundials of the prior art may require frequent adjustment prior to or during reading. It will be appreciated that the character of the scale employed by a sundial depends upon the configuration of the instrument. Thus, many sundials of the prior art require a nonlinear scale to compensate for the particular configuration chosen for the instrument. A further problem precipitated by the configuration of the instrument involves the distortion of the shadow cast by the gnomon as the earth moves on its axis. Many sundials of the prior art simply fail to adequately minimize this distortion.

The movement of the sum and the resulting shadow cast can give rise to considerable amounts of information. Because the declination of the sun varies continuously between the extreme values marked by the summer and winter solstices, and because the position of the shadow cast by a gnomon varies in a corresponding manner, the shadow cast can be employed to define within reasonable accuracy the month and date of the year. Many sundials of the prior art are simply not arranged so as to provide this sort of information.

Other sundials of the prior art provide no indication of the time of sunrise or sunset. Sunrise and sunset are defined as the time the upper limb of the sun rises above and dips below, respectively, the sensible horizon. Generally during these two portions of the day the light near the surface of the earth is quite subdued. Furthermore, there is the added problem that the time of sunrise and sunset varies within the declination of the sun. As a result, the definition of the time of sunrise and sunset is not even contemplated by most sundials of the prior art.

As the earth moves about the sun and the declination of the sun changes, the days become shorter in terms of the number of daylight hours. To provide more hours per working day, the time can be artificially changed by turning ahead the mechanical timepieces of a particular zone one or more hours. The time designated thereafter is termed daylight saving time. The change in the reading of a mechanical timepice of course is usually simple to arrange. However, many sundials of the prior art cannot be adjusted and as a result the reading provided is inaccurate.

The value of the declination of the sun has a number of significant applications. The value is used, for instance, in navigation and surveying. As indicated earlier, the declination varies continuously throughout the year and indeed from year to year. Furthermore, the value of the declination of the sun is only meaningful if it can be determined for a particular date. Thus, the declination of the sun is most commonly derived from charts expressly prepared for this purpose. If only an approximate value of the declination is desired, a properly configured sundial might be made to provide this information for the date of interest. Unfortunately, most sundials of of the prior art do not appear capable of providing this information.

To function properly, a sundial must be properly oriented. In many cases a fixture may not be available to ensure this proper orientation. Thus, it may be necessary to adjust the orientation of the sundial. This can be a particularly difficult problem if it is intended that the sundial be portable. Many sundials of the prior art simply do not contemplated adjustability and as a result the readings given thereby may be considerably in error.

The problems suggested in the preceding are effectively alleviated by a sundial whose arrangement is described in the previously mentioned related application, and which will be subsequently discussed herein.

Sun Compass Background

It has been recognized for some time that a sundial is capable of functioning as a compass in that a sundial correctly indicating time will be characterized by a dial meridian which points north. See in this connection U.S. Pat. Nos. 1,480,055, 2,032,462 and 2,441,636. Therefore, if the time is known independently of the sundial, and the sundial is oriented such that its gnomon, or stylus, indicates such time, then its dial meridian will be pointing north. On the face of the subject invention the shadow cast by the tip of the gnomon also indicates the sun's declination. Conversely, when the shadow is oriented to indicate the correct sun's declinaion which corresponds with date of year, and the said shadow is displayed upon the proper half of the dial indicating A.M. or P.M., then the correct time is indicated.

Sun compasses are useful, then, for indicating the true north direction or the true azimuth of any line of sight selected. This is in contrast to a magnetic compass which points generally toward either of the magnetic poles and is subject to large variations from the true north direction. These variations are continually changing from year to year and from one locale to another. Disturbances of the magnetic needle are also caused during periods when sun spots are most numerous. The magnetic compass is also subject to deviations of considerable magnitude when used in environments having local magnetic influences. Such deviations commonly occur in connection with tanks, airplanes, boats, automobiles and other instances involving ferrous metals and electrical apparatus producing substantial magnetic fields. Various methods of deviation correction, called compensation, have been devised for overcoming this error; however, one needs to know the direction of true north in order to make corrections for the aforementioned variations and deviations. Thus it can be seen that the accuracy of other compasses including gyroscopic types can be checked by a proper sun compass.

Heretofore, sun compasses have involved disadvantages discussed previously in connection with sundials. In addition, efforts to provide a sun compass which is truly portable and which will easily compensate for latitudinal and longitudinal variances have not been entirely successful.

It is, therefore, an object of the present invention to provide a sun compass which solves or alleviates the problems discussed above in connection with known sundials and sun compasses.

It is another object of the invention to provide a sun compass which is effectively adjustable to compensate for latitudinal and longitudinal variations.

It is a further object of the invention to provide such an adjustable sun compass which is truly portable.

It is also an object of the invention to provide a sun compass which can be set with reliable accuracy by longitude, latitude and date so as to indicate both watch time and the true north direction.

It is a further object of the invention to provide a sun compass which will indicate directly the sun's azimuth and altitude for any remote latitude, longitude, day and watch time.

It is another object of the invention to provide a sun compass which will indicate approximately either latitude or longitude (but not both) within a known standard time zone, if set by correct watch time, date and either latitude or longitude.

SUMMARY OF THE PREFERRED FORM OF THE INVENTION

A novel sun compass intended to accomplish the foregoing objectives involves a body portion which is movably mounted on a hemispherical, transparent base. The body has a concave inward, cylindrical face of fixed radius $r$. The body portion of the sun compass carries a gnomon, the tip of which coincides with the longitudinal axis of the cylindrical face. The gnomon casts a shadow on the cylindrical face which is dependent upon the hour angle and declination of the sun. The cylindrical face of the sun compass carries a plurality of generally parallel, equally spaced time lines which extend in a direction which is essentially longitudinal of the longitudinal axis of the cylindrical surface. These time lines designate the hours of the day. The tip of the gnomon casts a shadow which, when falling upon one or between two of the time lines at a location corresponding to the time of day, indicate that the longitudinal axis of the cylindrical face and the polar axis of the earth together define a plane extending essentially north an south through the earth. The cylindrical face also carries a plurality of generally parallel date lines which extend in directions generally perpendicular to the time lines. Thse date lines designate the months and the days. The shadow of the gnomon tip, when falling upon one or two of the date lines at a location corresponding to the actual date, indicates that the longitudinal axis of the cylindrical face and the polar axis of the earth together define a plane extending essentially north and south through the earth.

Latitudinal adjustment is afforded by a coil spring connected to the body portion. A knob is connected to the coil spring so as to displace the spring and thus the body when the knob is rotated.

Longitudinal adjustment is afforded by a second coil spring situated within the first spring. The second spring is connected to a gearing arrangement mounted on the body portion such that rotation of a second knob attached to the second spring, rotates the gearing and collectively shifts the time lines relative to the body.

A transparent hemispherical top is provided which has a sighting arc and a scale for measuring the altitude of the sun.

An alternate form of sun compass comprises a double walled cylindrical plate defining a chamber. The chamber is partially filled with a opaque, cling-free liquid. The liquid level simulates the horizon of the earth and aids in determining the time of sunrise and sunset.

THE DRAWINGS

Other objects and advantages of the present invention will become apparent with reference to the detailed description to follow of a preferred embodiment thereof wherein like reference numerals have been applied to like elements and in which:

FIG. 1 illustrates a perspective view of the earth and the surrounding celestial sphere with several representative heavenly bodies;

FIG. 2 illustrates a perspective view of the earth and a sundial according to the present invention operating in the Northern Hemisphere;

FIG. 3 illustrates a vertical sectional view taken along the lines 3—3 of FIG. 2;

FIG. 4 represents a sectional view of the earth looking south along the lines 4—4 of FIG. 3;

Figure 6:
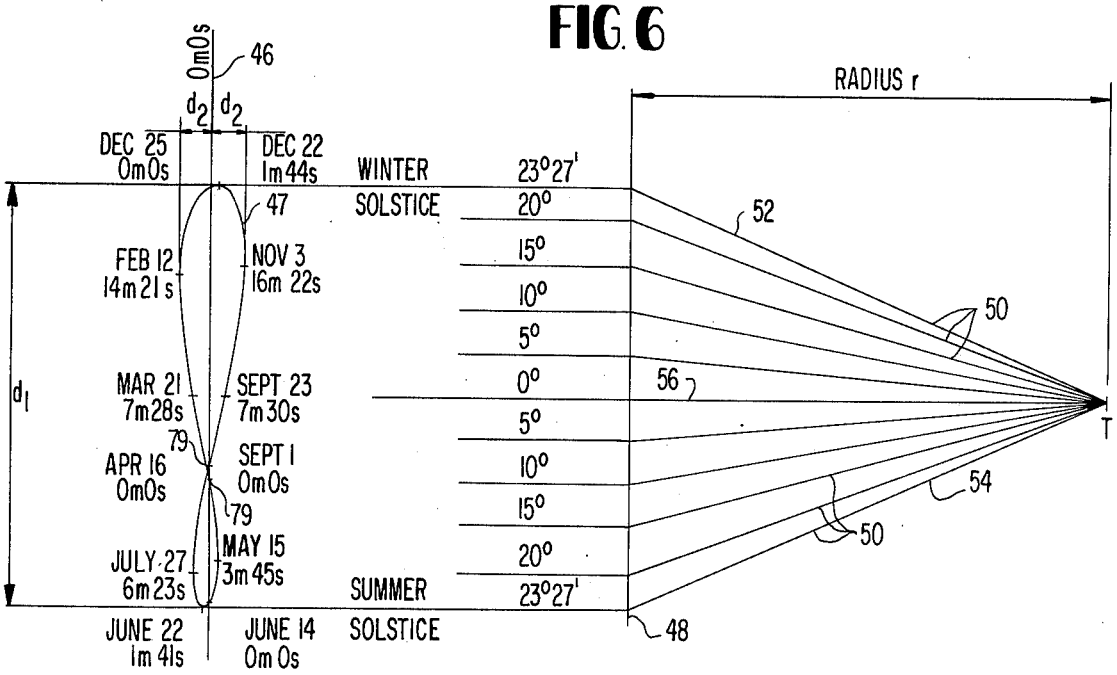
Figure 7:
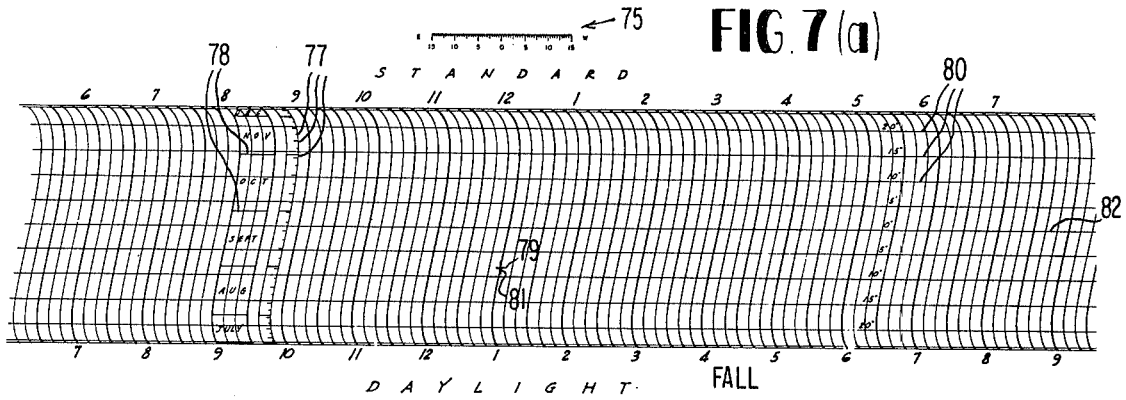
Figure 7:
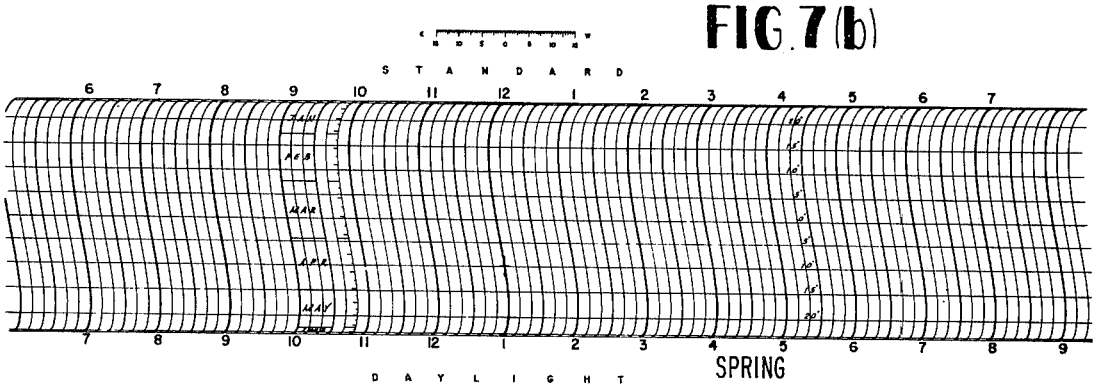
Figure 7:
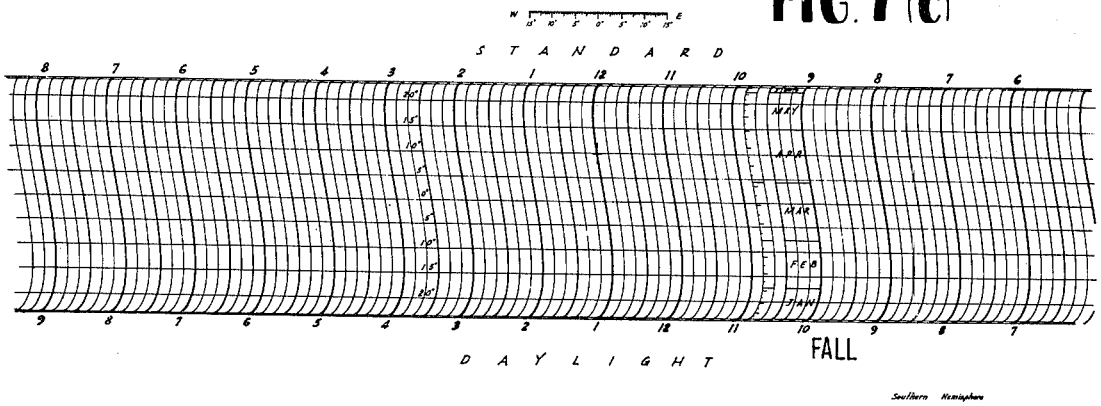
Figure 7:
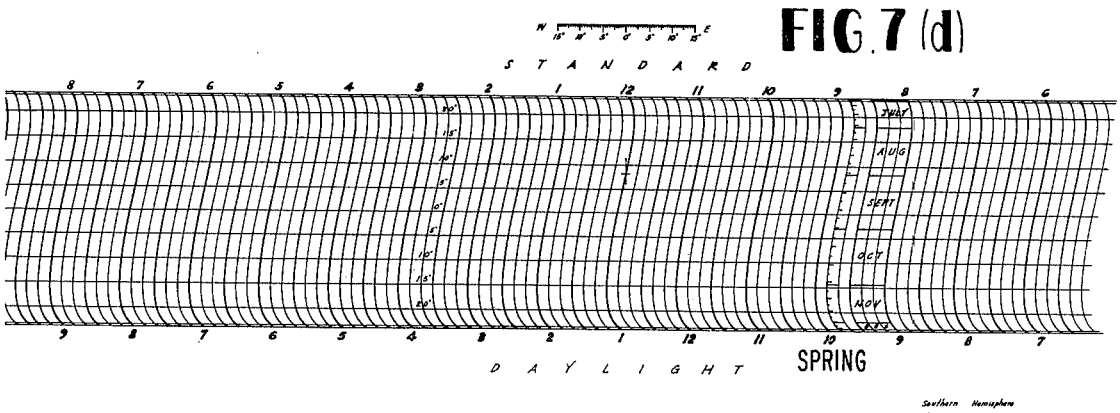
Figure 8A:
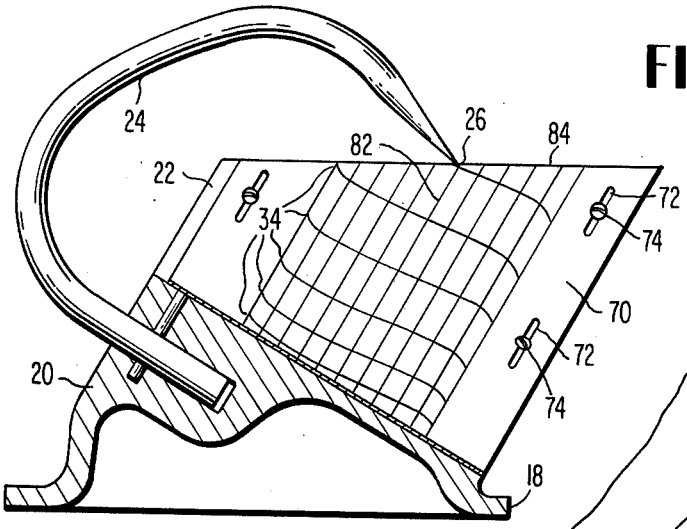
Figure 8B:
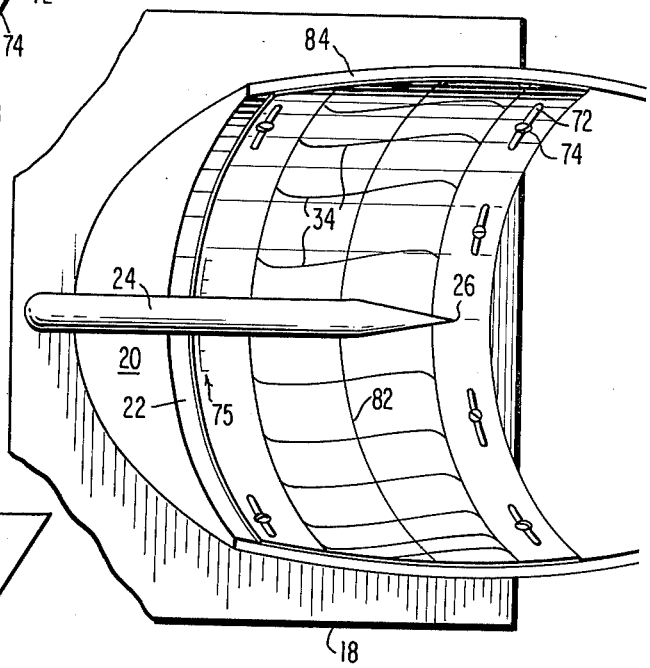
Figure 9A:
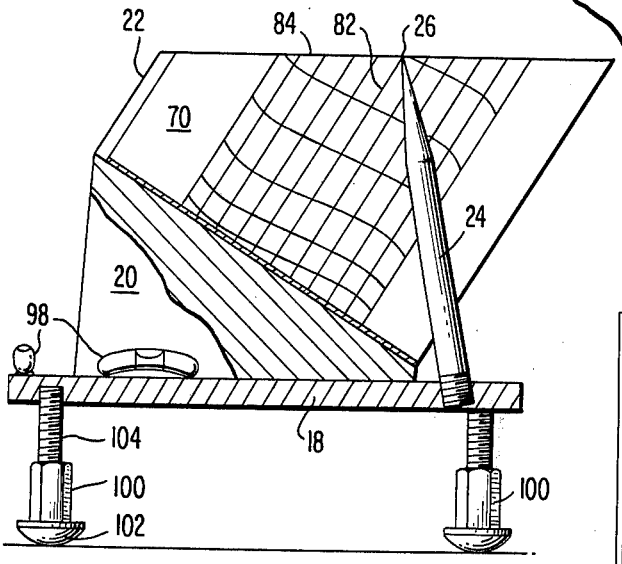
Figure 9B:
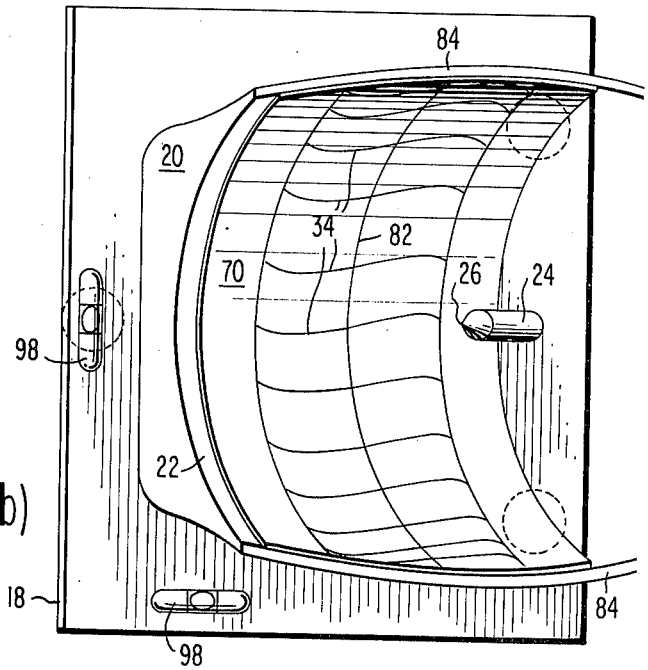

FIG. 5(*a*) through 5(*e*) illustrate various views of a sundial according to a preferred embodiment of the present invention;

FIG. 6 schematically illustrates the manner in which the time lines of the invention (for the Nothern Hemisphere) are generated and the relation thereof to the body of the sundial;

FIGS. 7(*a*) through 7(*d*) illustrate the time lines and other features characterizing the cylindrical surface of the sundial of the present invention for the spring and fall for both the Northern and Southern Hemispheres;

FIGS. 8(*a*) and 8(*b*) illustrate vertical, sectional, and top views of another embodiment of a sundial according to the present invention;

FIGS. 9(*a*) and 9(*b*) illustrate vertical, sectional, and top views of still another embodiment of a sundial according to the present invention;

FIG. 10 is an isometric view of a portable sun compass in accordance with the present invention.

Figures 16, 17, 18A, 18B, 18C, 18D, 18E:
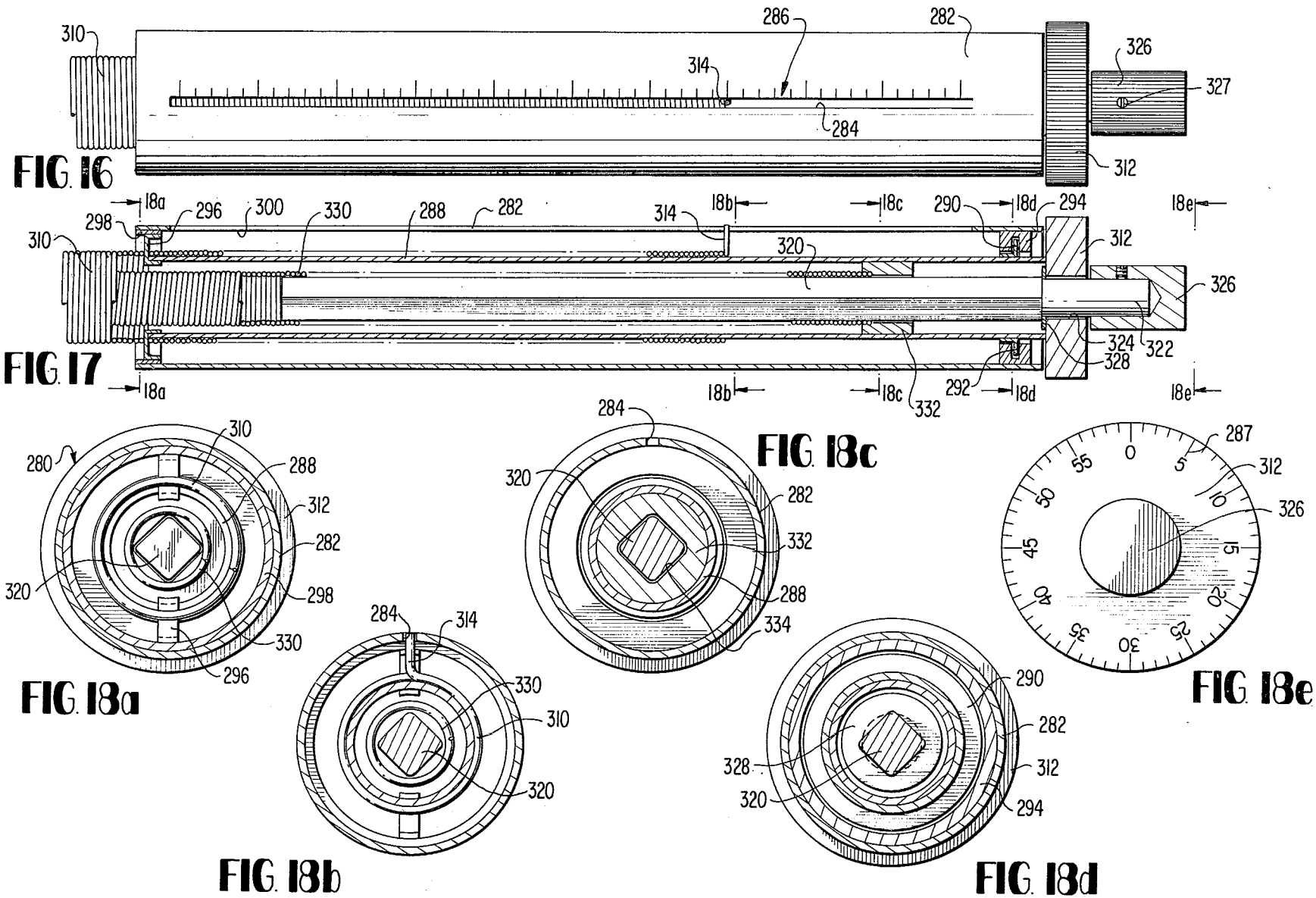

FIG. 11 is a fragmentary sectional view taken through the junction of top and base casing portions of the sun compass;

FIG. 12 is a view similar to FIG. 11 depicting means for rotating the top casing portion;

FIG. 13 is a cross-sectional view of the sun compass;

FIG. 14 is a front view of the sun compass with parts broken away;

FIG. 15 is a fragmentary view showing a gearing mechanism for longitudinally adjusting the sun compass;

FIG. 16 is a side view of an adjustment mechanism for the sun compass;

FIG. 17 is a longitudinal sectional view through the mechanism of FIG. 16.

Figure 19:
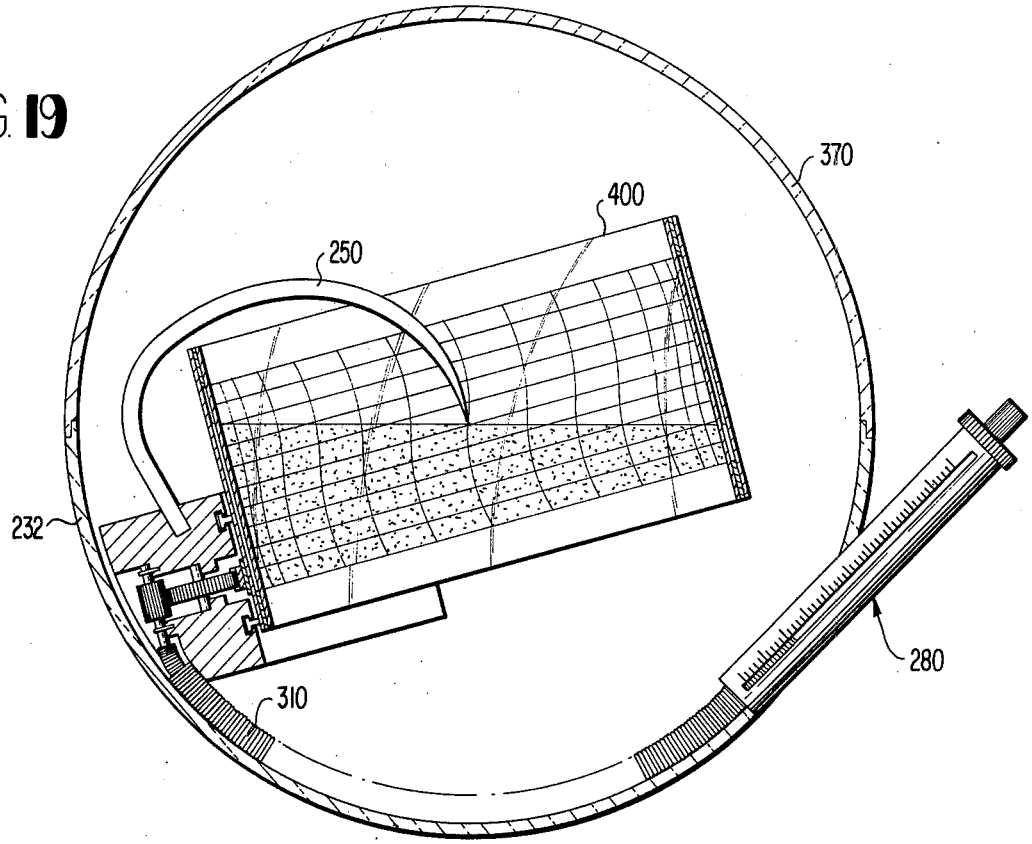
Figure 20:
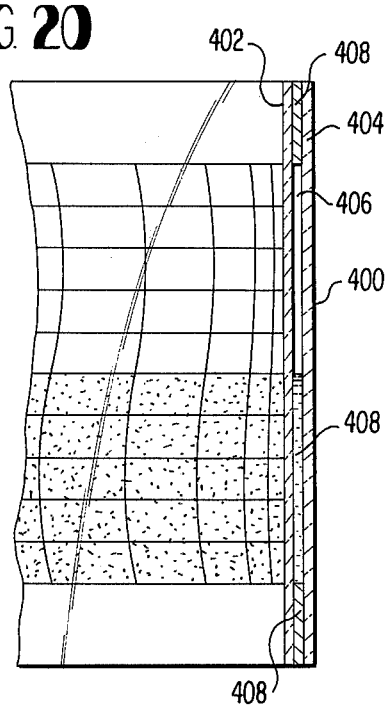
Figure 21:
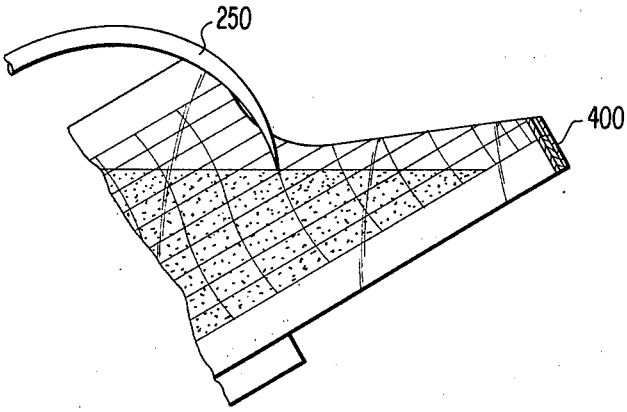

FIG. 18*a* is a cross sectional view taken along line 18*a*—18*a* of FIG. 17;

FIG. 18*b* is a cross sectional view taken along the line 18*b*—18*b* of FIG. 17;

FIG. 18*c* is a cross sectional view taken along line 18*c*—18*c* of FIG. 17;

FIG. 18*d* is a cross sectional view taken along line 18*d*—18*d* of FIG. 17;

FIG. 18*e* is a cross sectional view taken along line 18*e*—18*e* of FIG. 18;

FIG. 19 is a side elevational view, in vertical section of an alternate form of sun compass according to the present invention;

FIG. 20 is a fragmentary view of an end of the sun compass of FIG. 19 depicting a double-wall arrangement thereof; and FIG. 21 is a fragmentary view of a double-wall arrangement for use within latitudinal locations between 0° and 67°.

DETAILED DESCRIPTION

BASIC THEORY OF SUNDIALS

Though the movements of the heavenly bodies are quite complex, the analysis of these movements can be simplified by the use of a few basic assumptions. The most fundamental of these assumptions is that the earth 8, as illustrated in FIG. 1, is stationary and is concentrically surrounded by a rotating celestial sphere 10. An axis 12 formed by the prolongation of the poles of the earth 8 forms the axis of the celestial sphere. Hence, the equatorial planes 14 of the celestial sphere 10 and the earth 8 coincide. The celestial sphere 10 is assumed to have a radius of infinite magnitude and the heavenly bodies outside the solar system of the earth are located by projection to the surface of the celestial sphere. Thus, these heavenly bodies are all fixed relative to one another. The celestial sphere is assumed to rotate relative to the stationary earth at the rate of 360° 59.14 minutes per 24 hours of time. The rotation is from east to west.

The position of a heavenly body is conventionally defined by two quantities, viz., the direction and Greenwich Hour Angle of the body. The declination of the body is measured from the equatorial plane of the celestial sphere and is thus equal to the latitude of the point at which a line projected from the heavenly body to the center of the earth intersects the surface of the earth. For example, if a heavenly body were located at A, B, or C of FIG. 1, the declination thereof would be 58°, 15°, or −20° , respectively.

The declination of the sun varies over a range of approximately 47° of declination, 23.5° on either side of the equatorial plane of the celestial sphere. At the extremum values of the declination of the sun, the sun appears not to move either north or south. The sun reaches its extreme northern declination on June 21 and reaches its extreme southern position on December 22. These two dates are referred to in the Northern Hemisphere as the summer and winter solstice, respectively. As suggested, the midpoint between the summer and winter solstice occurs when the sun is bisected by the equatorial plane of the celestial sphere. This point is referred to as the equinox and is characterized by the fact that night and day are of equal length over the entire earth. The sun is bisected by the equatorial plane of the celestial sphere on two different dates of the year, March 21 and September 22. These two dates are referred to in the Northern Hemisphere as the vertical and autumnal equinox, respectively.

The Greenwich Hour Angle of a heavenly body is defined as the angle measured west from the Greenwich Meridian to the meridian immediately beneath the heavenly body. The Greenwich Meridian is located at 16 on FIG. 1 and is a heavenly body were located, for example, at A, B, or C, the Greenwich Hour Angles would be 80°, 60°, or 70°, respectively. Because the celestial sphere is assumed to rotate from east to west relative to the stationary earth, the Greenwich Hour Angles of all heavenly bodies are continuously increasing. Because the angular speed of rotation of the celestial sphere is known, the increase in the Greenwich Hour Angle of the heavenly body relative to any Greenwich time can be calculated. However, conventionally only the time from Greenwich Midnight ($0^h$) is computed.

The concept of time has two distinct aspects, viz., elapsed time and moment of time. Elapsed time is that which is familiar to most people, i.e., the sort of time of which there are 24 hours in a day. This time is also referred to as means solar time, mean time, or civil time. A moment of time includes the year, month, day, and elapsed time since midnight reckoned from a particular meridian. Greenwich Civil Time, for example, is civil time calculated from midnight at the Greenwich Meridian. Local Civil Time is somewhat more general and is civil time calculated from any chosen meridian.

The sun appears to move around the celestial sphere once every year. Concurrently, the declination of the sun on the celestial sphere changes because the axis of the earth tilts relative to the plane of the orbit of the earth around the sun. The degree of this tilt varies continuously throughout the year and as the inclination of the axis of the earth varies, the declination of the sun correspondingly changes. As indicated earlier, this declination ranges from approximately 23.5° north to 23.5° south of the celestial equator. In actuality the earth does not travel around the sun in a truly circular path. Thus, elapsed time is not based upon the actual daily passage of the sun, but rather on the average movement of the sun. In actual fact the sun is sometimes ahead and sometimes behind noon Local Civil Time by an amount which ranges up to more than one quarter of an hour. The extent of this variation is defined by an equation of time to be discussed in detail at a later point. of the sun, but rather on the average movement of the sun. In actual fact the sun is sometimes ahead and sometimes behind noon Local Civil Time by an amount which ranges up to more than one quarter of an hour. The extent of this variation is defined by an equation of time to be discussed in detail at a later point.

Ordinarily time is not defined as a continuous function of longitude, but instead is expressed in increments. In other words, the earth is divided into various areas referred to as time zones, each of which subtend a number of degrees of longitude. In each of these zones the time used by the population is constant. To this end, there exists in each zone a standard meridian on which the time designated for the zone is essentially correct. However, at all other locations east and west of the standard meridian, the time designated for the zone is not correct. For instance, if the location in question is east of the standard meridian, the actual time at this location is later than that designated for the zone as a whole. Similarly, if the location in question is west of the standard meridian, the actual time is earlier.

Proposed Sundial

The sundial disclosed in the invention's aforementioned related application is discussed in connection with FIGS. 2, 3, 5*a* through 5(*e*), 6 and 7(*a*) through 9(*b*). This sundial includes a base 18 which carries a body portion 20. The body portion is concave inward and is characterized by a cylindrical surface 22 radius fixed rasdius *r* (see FIG. 5(*a*)). A gnomon 24 is connected to and cantilevered from the body portion 20 in such a way that a tip 26 thereof coincides with the longitudinal axis 28 of the cylindrical surface 22. As perhaps best illustrated in FIGS. 2 and 3, the gnomon 24 casts a shadow on the cylindrical surface 22 which is dependent upon the hour angle and declination of the sun 32. The gnomon is comprised of a shaft which is relatively heavy and which narrows to the relatively fine tip 26. A configuration of this type optimizes the clarity of the shadow cast by the gnomon during hazy weather.

Disposed on the cylindrical surface, as perhaps best illustrated in FIGS. 5(*a*) through 5(*e*) is a plurality of generally parallel, equallly spaced time lines 34. These times lines extend in a direction which is generally parallel to the longitudinal axis 28 of the cylindrical surface and are longitudinally bounded by lines which extend circumferentially around the cylindrical surface. During the course of a day the shadow cast by the gnomon will fall on or between various of these time lines. This interrelation between the shadow cast by the gnomon and the time lines can be employed to define the time of day.

To facilitate the reading of the time of day, the time lines are comprised of a plurality of principal time lines 36 spaced apart about the circumference of the cylindrical surface 22 a distance $d_4$ defined approximately by the formula $d_4 = (r\pi(15°)/180°$ (see FIG. 5(*c*)). The principal time lines are designated as hour lines to represent various hours of the day. At one longitudinal extreme of the hour lines the time is designated in standard time and at the opposite extreme the time is designated in daylight saving time. Between adjacent principal time lines there is disposed a number of secondary time lines 38 also parallel to the hour lines. These time lines define intervals of minutes between the adjacent hour lines 36. These hour lines are illustrated in FIG. 5(*a*) at 38 between only two adjacent time lines for simplicity. It must be understood that in practice the secondary time lines are disposed between each and every principal time line. These secondary time lines enhance the accuracy with which the time of day can be determined.

In operation, the sundial is oriented so that the longitudinal axis 28 of the cylindrical surface 22 and the polar axis 40 of the earth define a plane which extends essentially north and south through the earth. In other words, the sundial is oriented along a line extending north and south relative to the surface of the earth. Furthermore, in order to present the face of the sundial to the sun in an optimal manner, the sundial is configured as illustrated in FIGS. 3 and 5(*a*)–5(*e*) so that the longitudinal axis 28 of the cylindrical surface 22 forms an angle $\gamma$ with a plane normal to the earth's surface, which angle $\gamma$ is equal to the latitude of the point of observation 44 of the sun 32.

The non-conformity in the rate at which the sun appears to pass around the earth causes a discrepancy between Local Civil Time as would be defined by a mechanical timepiece and the time otherwise indicated by the position of the sun relative to the meridian of observation, i.e., the local meridian. As indicated earlier and as illustrated in FIG. 4, at noon Local Civil Time the sun may have already passed overhead or may as yet not have passed overhead. In other words, the hour angle of the sun may precede or follow the hour angle of noon Local Civil Time. FIG. 4 illustrates schematically the consequence of this non-uniformity in the rate of movement of the sun as seen from the earth at a given meridian of observation. FIG. 4 is a section of the earth taken parallel to the equatorial plane and is looking south. Thus, the sun will appear to move in the direction indicated by the arrow 46. The sundial is indicated generally at 6 and the arrows D, E, and F indicate the approach of rays of sun corresponding to three different positions of the sun. If the sun happens to be directly overhead at noon Local Civil Time, rays of the sun will strike the sundial as indicated by the arrow and would properly indicate noon Local Civil Time. If, however, the sun precedes noon Local Civil Time, rays striking the sundial would move as indicated by the arrow E and the shadow cast by the gnomon 24 of the sundial would fall slightly to the left of the point at which the shadow would have fallen had the sun been located overhead. Similarly, if the sun follows noon Local Civil Time, rays striking the sundial will move in the direction illustrated by arrow F and the shadow of the gnomon 24 will be cast slightly to the right of the shadow which would be cast if the sun were overhead.

The extent to which the hour angle of the sun precedes or follows noon Local Time varies throughout the year and indeed varies throughout any day.

Clearly, this variation in the position of the sun causes an inaccuracy in the reading of the sundial relative to the time indicated by a mechanical timepiece. It should be emphasized that this inaccuracy occurs not only for noon but also for other times throughout the day as well. The position of the sun simply varies relative to where it should be on an average for a given hour and as a result the shadow cast by the gnomon falls on varying points with respect to any given hour of Local Civil Time. The error resulting from the variations in the position of the sun may amount to more than one quarter of an hour for certain days of the year.

As indicated earlier, the extent to which the sun precedes or follows noon Local Civil Time can be defined in degrees by an expression referred to as the equation of time. In particular, the equation of time is $\alpha$ = Greenwich Hour Angle of the sun − Greenwich Hour Angle of noon Local Civil Time. Both hour angles in the equation are concurrently measured or defined and $\alpha$ thus amounts to the algebraic difference between the Greenwich Hour Angle of the sun and the Greenwich Hour Angle of noon Local Civil Time.

If the time of day were to be defined solely by the position of the sun relative to a meridian of observation, the time so defined would be referred to as True Solar Time. True Solar Time thus is a moment of time based on the passage of the sun for the day for a particular point of observation. True Solar Time does not correspond to Local Civil Time because of the variations mentioned in the rate at which the sun moves or appears to move overhead. However, Local Civil Time can be determined from True Solar Time by the formula: Local Civil Time = True Solar Time - Equation of Time. In effect, True Solar Time is corrected for variations in the rate of movement of the sun and the foregoing equation affords a general formula for determining the Local Civil Time for any hour of the day. It would, of course, be extremely cumbersome to apply the correction described in the foregoing to the reading of a sundial.

For a chosen local hour angle $t$, declination $d$, and latitude $l$, the altitude $h$ of the sun from a given point of observation can be defined approximately through the formula $h = \sin^{-1}(\cos t + \tan l \tan d) \cos l \cos d$. *Using the altitude derived, the azimuth or bearing of the sun* $A_z$ relative to a given point of observation can be determined through the formula $$A_z = \cos^{-1}\left[\frac{\sin d}{\cos h \cos l} - \tan h \tan l\right].$$

The information used in and derived from the two immediately preceding equations has been found to generate lines on a cylindrical surface, of the type incorporated in the sundial of the invention, which are strictly parallel to the longitudinal axis of the cylindrical surface. The parallel character of the lines was discovered and can be demonstrated by plotting on the cylindrical surface for a given local hour angle the points of intersection with the surface of a line projected from the tip of the gnomon through the cylindrical surface. The projected line is inclined to the horizontal and rotated about the vertical to angles defined by the altitude and bearing of the sun. Several such points can be generated by varying the declination employed in the two formulas just presented.

It will be recalled that the tip of the gnomon coincides with the longitudinal axis of the cylindrical surface and thus the line projected therefrom simulates the passage of a ray of sun past the tip of the gnomon to impinge upon the cylindrical surface of the sundial. As will be explained in more detail in the course of subsequent discussion, the tip of the gnomon not only coincides with the longitudinal axis of the cylindrical surface, but also is in a plane essentially perpendicular to the longitudinal axis and essentially bisecting the cylindrical surface. Thus, if one projects a line, from the point defined by the intersection of the longitudinal axis of a cylindrical surface and a transverse plane orthogonally bisecting the surface, at the angles of bearing and altitude determined for a given local hour angle and various declinations, a line will be generated on the cylindrical surface which is parallel to the longitudinal axis. This phenomenon will be similarly observed for other local hour angles. As a result, a plurality of mutually parallel, straight lines strictly parallel to the longitudinal axis of the cylindrical surface can be generated.

Lines generated in this manner represent lines 46 of True Solar Time as shown in FIG. 6, and can be reconfigured to yield Local Civil Time by applying the results of the equation of time. The necessary changes in the lines are effected by varying the time lines on the cylindrical surface of the sundial from lines generated strictly parallel to the longitudinal axis thereof and representing True Solar Time by an amount $d_2$ defined approximately by the equation $d_2 = (r\pi\alpha)/180°$, $\alpha$ being the appropriate result of the equation of time and $r$ being the radius of the cylindrical surface. The quantity $d_2$ represents a shifting of a time line otherwise strictly parallel to the longitudinal axis and representing True Solar Time from its configuration strictly parallel to the longitudinal axis of the cylindrical surface of the sundial. Alternatively, $d_2$ could be expressed approximately as $d_2 = r \sin \alpha$.

When the equation of time yields a positive value for $\alpha$ for a particular declination of the sun, the Greenwich Hour Angle of the sun precedes noon Local Civil Time and the time lines must curve to the east of the time lines otherwise strictly parallel to the longitudinal axis of the cylindrical surface. Similarly, if the equation of time yields a negative value for $\alpha$ for a particular declination of the sun, the Greenwich Hour Angle of the sun follows noon Local Civil Time and the time lines must curve to the west of the time lines otherwise strictly parallel to the longitudinal axis of the cylindrical surface. Representative $d_2$ distances are shown in FIG. 6, relative to a configuration 47, to be soon discussed, which represents the loci of plotting distances $d_2$ relative to a particular time line 46.

In any case, the time lines as they represent True Solar Time, or reconfigured to reflect Local Civil Time, are longitudinally bounded by circumferential lines 36 spaced apart a distance $d_1$ (as shown in FIG. 6) defined approximately by the equation $d_1 = 2r \sin 23.5°$. It will be recalled that the tip of the gnomon of the sundial according to the present invention defines a point which is both on the longitudinal axis of the cylindrical surface of the sundial and in a plane essentially perpendicular to the longitudinal axis bisecting the cylindrical surface. The intersection of this plane with the cylindrical surface defines a circumferential line which constitutes the line of zero declination of the sun on the face of the cylindrical surface of the sundial. Inasmuch as the sun varies in declination from 23.5° north to 23.5° south of the equatorial plane of the earth, the shadow cast by the tip of the gnomon will move essentially north and south of the line of zero declination of the sun on the cylindrical surface in a progressive manner over the course of a year. If a ray of light is projected from the sun through the tip of the gnomon to the cylindrical surface of the sundial, a variable angle of up to approximately 23.5° will be formed with planes perpendicular to the axis of the cylindrical surface. This phenomenon is observed for both north and south declinations of the sun. Thus, as the sun moves from the summer to winter solstice, or vice versa, the shadow cast by the tip of the gnomon should vary in location from a distance $r \sin 23.5°$ north of the line of zero declination to a distance $r \sin 23.5°$ south of the line of zero declination. Thus, over the course of a year the cumulative tavel $d_1$ of the shadow cast by the tip of the gnomon is defined by the formula $d_1 = 2r \sin 23.5°$.

As illustrated in FIG. 6, for a particular point of observation of the sun, any particular time line 46 strictly parallel to the longitudinal axis and indicating True Solar Time is reconfigured to form essentially a figure eight 47 about the strictly parallel line as the declination of the sun varies over the course of the year between the summer and winter solstices. The line 46, in FIG. 6, represents a line on which the shadow cast by the tip of the gnomon would fall if the sun, as assumed, moved about the earth at a constant rate. The point T in FIG. 6 repersents the location of the tip of the gnomon, while the vertical line 48 represents the cylindrical surface of the sundial in longitudinal section. The various rays 50 of the sun projected from the point T represent the projection of rays of sun as the sun moves from the declination corresponding to the winter solstice, to the declination corresponding to the summer solstice. Rays 52 and 54 represent particular rays that would impinge upon the sundial during the winter and summer solstices, respectively. The ray 56 represents the ray impinging the sundial at the point or line of zero declination of the sun on the dial. It will be noted that to the left of the line 48 the various angles of the rays 50 corresponding to the various declinations of the sun are listed from 0° to approximately 23.5°. The figure 23.5° is only approximate and is used for convenience. More accurately, the sun varies in position from extremum declinations figure and south of 23°, 27 minutes.

As shown in FIG. 6, since the configuration 47 is computed in accordance with the $d_2$ equation, so as to afford improved accuracy in accordance with the FIG. 4 discussion, the longitudinal axis of FIG. 47 is not parallel to the longitudinal lines of the sundial face, i.e., configuration 47 is "canted" in relation to line 46.

Adjacent the figure 8 47 formed about the line 46 are a number of dates and corresponding values of the equation of time which are critical to the configuration of the figure 8. Knowing the value yielded by the equation of time for $\alpha$ in minutes, the distance of the line forming the figure 8 47 from the line 46 can be defined in inches, or for that matter, in any other unit of length. The determination of the distance can be effected by realizing that in a 24-hour period of time, containing 1440 minutes, the shadow cast by the gnomon should move around a full circumference C of the cylindrical surface (assuming a transparent earth). This distance C is defined by the equation $C = 2 \pi r$, where $r$ is the radius of the cylindrical surface. Since the distance C will be travelled in 1440 minutes, an equation of scale, 1440 minutes $= 2 r$ can be developed. Thus, 1 minute $= (2 \pi r)/1440$ and the distance so defined will be in the units of $r$. Once this factor for 1 minute of time is derived, it can be applied to the times yielded by the equation of time to define a distance. Alternatively, the distance between the line 46 and the line forming the figure 8 47 can be defined by the equation $d_2 = r \alpha$, where $\alpha$ is the result of the equation of time expressed in radians. The distance $d_2$ can also be defined by the equation $d_2 = (r \pi \alpha)/180°$ if $\alpha$ is in degrees since the factor $\pi/180°$ effects the conversion to radians.

The equation of time varies somewhat relative to declination from year to year and this may engender minor empirical modifications of the $d_2$ figures. It has been discovered, however, that for each critical point on the figure 8 47 surrounding the line 46, a plotting of declination versus the result of the equation of time for a series of years yields essentially a straight line. If the data forming the straight line is averaged, the increment of the equation of time separating the point defined by the averaged data from the point of interest, e.g., the point of zero declination or zero equation of time, can be determined. An ephemeris can be used to obtain the total change in the equation of time over an entire day corresponding to the date of the critical point. Using this information, a ratio of the increment of the equation of time over the change for an entire day can be formed. If this ratio is multiplied times 24 hours, the average Greenwich Civil Time at which the phenomenon of interest occurs can be determined. Knowing the average Greenwich Civil Time at which the critical phenomenon occurs, the relation of this time to noon Local Civil Time can be determined. Knowing the number of hours difference between the Greenwich Civil Time of the event and noon Local Civil Time, the change in the declination which will occur in this interval of time can be calculated by multiplying the number of hours times the hourly change in declination given for the pertinent date by an ephemeris. This process yields the most accurate information for locating the critical date and corresponding value of the equation of time on the cylindrical surface of the sundial. Performing this operation for all of the critical points and correctly locating these points on the cylindrical surface of the sundial optimizes the accuracy of the figure eight 47 formed about the line 46. However, even with such corrections the $d_2$ figures will be considered to approximately define the curve 47, for purposes of this discussion.

The figure eight illustrated in FIG. 6 can be formed for each and every time line across the full face of the cylindrical surface of the sundial and each can be marked to indicate the appropriate time of day. The tip of the gnomon casts a shadow which will fall upon or between various of the time lines over the course of the day to indicate the time of day.

Preferably the time lines are collectively bisected longitudinally and as bisected (i.e., bisected from tip extremity to tip extremity) are collectively alternately disposed on the cylindrical surface of the sundial to alternately provide time lines for the fall and spring months. In other words, two different sets of lines are applied to the cylindrical surface, one for fall and one for spring. These two different sets of lines are perhaps best illustrated in FIGS. 7(*a*) through 7(*d*) and correspond to lines 34, 36 previously discussed. It will be noted that FIGS. 7(*a*) and 7(*b*) are to be employed in the Northern Hemisphere, while FIGS. 7(*c*) and 7(*d*) are employed in the Southern Hemisphere. The time lines generated for the Southern Hemisphere are, of course, generated in the same manner as those for the Northern Hemisphere, the only significant difference being in the signs of the various values employed in the several formulae discussed in the foregoing. It will be noted that each of the sets of time lines illustrated in FIGS. 7(*a*) through 7(*d*) are designated at one extreme in hours of standard time and at the opposite extreme in hours of daylight saving time. The bisection of the figure eights which would otherwise define the time lines is effected in order to render the sundials readily readable.

The sundial is configured to present a cylindrical surface or face to the sun so that each ray must travel a constant distance from the tip of the gnomon to the cylindrical surface of the sundial for a given declination. Thus, for each unit of time the shadow cast by the tip of the gnomon travels a constant distance around the circumference of the cylindrical surface. As a consequence, the time lines can be disposed at regular intervals about the circumference of the cylindrical surface. If the face of the sundial were flat rather than cylindrical, for instance, time lines would have to be placed at progressively increasing intervals from noon to the morning or evening hours. The combination of the cylindrical surface and the location of the tip of the gnomon at the longitudinal axis thereof in the plane of zero declination of the sun on the sundial, permits the use of a linear scale and minimizes distortion in the shadow cast by the gnomon.

As indicated earlier, if the meridian of observation of the sun does not coincide with the standard meridian of the time zone within which the meridian of observation is located, the time as read from the sundial will not be equivalent to standard or daylight saving time. If the lines of time are reconfigured to take into consideration the variations in the rate of apparent travel of the sun as described in the preceding paragraphs, the sundial at any location will provide an accurate reading of Local Civil Time, but Local Civil Time still will not coincide with standard time unless the meridian from which Local Civil Time is determined, i.e., the meridian upon which the sundial is located, coincides with the standard meridian. This problem can be solved if it is realized that the magnitude in the discrepancy between the Local Civil Time and standard or daylight saving time depends upon the extend to which the meridian of observation is east or west of the standard meridian. Because the sun appears to move 15° per hour, there should exist a discrepancy of 4 minutes for every degree of longitude the meridian of observation is to one side of the standard meridian. If the cylindrical face of the disclosed sundial is employed, this discrepancy can be avoided by rotating the lines of time collectively to the east or west about the axis of the cylindrical surface. If the point of observation of the sun is to the west of the standard meridian of the time zone in which the sun is being observed, the time lines should be collectively rotated to the west about the longitudinal axis of the cylindrical surface. Similarly, if the point of observation of the sun is east of the standard meridian, the time lines should be collectively rotated to the east. The lines should be rotated the same number of degrees in the appropriate direction that the meridian of observation is to one side of the standard meridian.

The sundials illustrated in FIGS. 5(*a*) through 5(*e*), 8(*a*) and 8(*b*) represent two alternative approaches to the solution of the problem discussed in the foregoing. In the preferred embodiment illustrated in FIGS. 5(*a*) through 5(*e*), the time lines are collectively rotated by rotating the entire cylindrical surface and the time lines together as a unit about the longitudinal axis of the cylindrical surface.

An examination of FIG. 5(*a*) will reveal that the cylindrical surface 22 is carried by a semi-cylindrical body 56. The upper edge 58 of the cylindrical body 56 fits within a channel 60 formed in the body portion 20 by a groove 61 and an arcuate retaining plate 62. Disposed within the channel 60 may be any bearings desired or appropriate to facilitate movement of the cylindrical body 56 about the longitudinal axis 28 of the cylindrical surface 22. The lower portion of the cylindrical body 56 is cradled in an arcuate portion 64 of the body portion 20 of the sundial. Within the interior of the body portion 20, is a retaining bolt 66 which threads into the cylindrical body 56 and secures thereto a retaining clip 68. The retaining clip 68 bears against a portion of the arcuate cradle portion 64 and acts as a brake to retain the cylindrical body portion 56 in place relative to the body portion 20 of the sundial. A sleeve 69 is attached to the bolt 66 to limit movement of the bolt and prevent permanent bending of the clip 68. As a result of the manner in which the cylindrical body 56 is connected to and carried by the body portion 20, the cylindrical body and the time lines carried thereby can be rotated about the longitudinal axis 28 of the cylindrical surface 22 as a unit.

Referring now to the embodiment illustrated in FIGS. 8(*a*) and 8(*b*), the time lines themselves are in this case collectively rotatable to the east or west about the cylindrical surface to compensate for differences between Local Civil Time and the time of the standard meridian of the zone of time in which the sun is being observed. In this embodiment, the time lines are disposed on a cylindrical sheet 70 which is in turn carried by the cylindrical surface 22. The sheet 70 is normally planar to facilitate reproduction but is flexible for convenient application to the cylindrical surface of the sundial, or it may be permanently formed. Disposed in the sheet carrying the time lines are a number of slots 72 through which pass a like number of screws 74 or other suitable fasteners. These fasteners are secured to the sundial and serve to firmly restrain the sheet carrying the time lines from movement in a direction parallel to the longitudinal axis of the cylindrical surface. Concurrently, these fasteners permit the sheet carrying the time lines to be rotated relative to the cylindrical surface about the longitudinal axis thereof.

Regardless of whether the embodiment of FIGS. 5(*a*) through 5(*e*) or 8(*a*) and 8(*b*) are used, the characteristics of the time lines themselves remain the same.

The general form 47 depicted in FIG. 6 (or the "half" forms 34, 36 or 77 depicted in connection with FIGS. 5(*a*) through 5(*c*) and 8(*a*) through 9(*b*) are similar in form and concept to the configurations depicted in the following U.S. Pat. Nos: Christian, 303,118, (Aug. 5, 1884); Crehore, 794,787 (July 18, 1905); O'Sullivan, 1,651,621 (Dec. 6, 1927); De Bogory, 1,674,161 (June 19, 1928).

It can be noted from an examination of FIGS. 7(*a*) through 7(*d*) that in all cases one of the time lines is designated a noon time line of standard time. It will be also recalled from the discussion of FIG. 6 that there exists a point along the time lines; as reconfigured to reflect values of the equation of time at which the equation of time yields a value of zero. Thus, as shown in FIG. 7(*a*) for a location N8°15′, there is a point 79 at which there is no variation in the hour lines from a time line strictly parallel to the longitudinal axis of the cylindrical surface. Thus, in each of the systems of lines illustrated in FIGS. 7(*a*) through 7(*d*) there is disposed a relatively short base line 81 which is parallel to the longitudinal axis of the cylindrical surface when the time lines are on the cylindrical surface. This base line intersects the noon time line of standard time at the point at which the time line varies a zero amount from a line strictly parallel to the longitudinal axis of the cylindrical surface. This base line is normally on the cylindrical surface with the time lines and can be used as a reference mark in the rearrangement of the time lines.

It will be also noted from an examination of FIG. 5(*c*) that the sundial includes an indicium 76 directed along a line parallel to the longitudinal axis of the cylindrical surface. This line may extend along the locus of points defining the vertically lowest points of successive circumferential lines extending about the cylindrical surface. In the case of the embodiment illustrated in FIG. 5(*c*) the indicium happens to take the form of opposed arrows 76. However, it will be appreciated that a single straight line or a vernier scale could be also used. In any case, the sundial is set to read in standard time by shifting the relative locations of the base line and the indicium a distance $d_3$ defined approximately by the formula $d_3 = (r\ \pi\ \theta)/180°$, in which $\theta$ equals the angular difference between the longitude of the standard meridian of the zone of time in which the sun is being observed, and the longitude of the meridian of the point of observation of the sun. In other words, either the cylindrical body 56 of FIG. 5(*c*) or the sheet 70 of FIG. 8(*a*) are rotated about the longitudinal axis of the cylindrical surface to move the base line relative to the indicium. The distance may also be $d_3$ defined approximately by the formula $d_3 = r \sin \theta$.

Preferably as illustrated in FIGS. 5(*c*) and 8(*b*), as well as FIGS. 5(*a*) through 5(*d*), a scale 75 is disposed on the body portion in fixed relation to the time lines. This can be accomplished as in FIG. 5 by disposing the scale directly on the cylindrical surface or, on the sheet 70 as illustrated in FIG. 8(*b*). Preferably the scale 75 is calibrated in degrees and extends a relatively short distance about the circumference of the cylindrical surface. The zero degree mark of the scale 75 is axially in line with the base line intersecting the noon time line of standard time and the indicium if the standard meridian of the zone of time which the sun is being observed coincides with the meridian of the point of observation of the sun. Otherwise, by shifting the time lines relative to the indicium a number of degrees equal to the number of degrees the meridian of observation is from the standard meridian, the sundial can be arranged to read directly in the standard or daylight saving time of the zone in which the sun is observed.

It has been found that in addition to giving the time of day in standard or daylight saving time, a sundial can be employed to define both the date in terms of month and day of the year and the declination of the sun for that day. The time of the year, i.e., the month and day, can be determined because of the fact that the declination of the sun varies continuously throughout the year. It can be appreciated from an examination of FIGS. 7(*a*) through 7(*d*), in combination with a consideration of FIG. 6 and the earlier discussion thereof, that the sundial is comprised of a plurality of parallel, spaced apart date lines 77 which are normally disposed on the cylindrical surface and extend at least partially therearound. The distances between the date lines define ranges of declination of the sun and the locations of these date lines along the lines define the month of the year and the approximate date thereof as the shadow of the tip of the gnomon is cast thereupon or therebetween. Upon close examination, it will be appreciated that certain of the date lines 78 are prolongated and define therebetween distinct months of the year. For instance, the prolongated date lines of FIG. 7(*a*) define the months of July, August, September, October, November and December. The remaining date lines are shorter and define dates within the particular months.

An examination of FIGS. 7(*a*) through 7(*d*) will also reveal that the sundial is comprised of a plurality of lines of declination 80 which are disposed on the cylindrical surface parallel to the line of zero declination 82 referred to earlier. These lines of declination 80 extend on either side of the line of zero declination seriatim to terminal points of the time lines and serve to define the value of the declination of the sun as the shadow of the tip of the gnomon is cast thereupon or therebetween. It will be noted that the values of declination accompanying each line of declination range up to approximately 23.5° on either side of the line of zero declination. The basis for this range and the mechanics of the casting of the shadow on the sundial to correspond with various declinations of the sun throughout the year was discussed in detail in connection with the discussion of FIG. 6. Inasmuch as the line of zero declination is located as described earlier, the range of declinations and the placement of the lines of declination at regular intervals affords an accurate reading of the declination of the sun throughout the year.

A further, very significant advantage can be derived from the use of both date lines and lines of declination of the cylindrical surface of the sundial, viz. the sundial can be very accurately aligned. Knowing the date, the sundial can be manipulated (after leveling as described later) until the shadow of the tip of the gnomon falls on the correct date line. Similarly, knowing the declination for a particular date, the sundial can be manipulated until the shadow cast by the tip of the gnomon falls on the correct line of declination. In either case, since the shadow fals on the proper line, the sundial is properly oriented.

Sunrise and sunset are defined, respectively, as the time at which the upper limb of the sun either moves above or below the sensible horizon. It can be appreciated from examination of FIGS. 5(*a*) and 8(*a*) that the cylindrical surface of the sundial is horizontally truncated by a horizontal plane which passes through the sundial in a manner essentially tangential to the surface of the earth at any particular point of observation. The plane of truncation thus essentially coincides with the plane which for practical purposes approximates the sensible horizon at any particular point of observation. The effect of the truncation is to form horizontal edges 84 which bound the cylindrical surface and interrupt the time lines, the lines of declination, and any date lines which extend to the edge 84. As the upper limb of the sun either moves above or below the sensible horizon, a ray of sunlight travelling therefrom by necessity travels in a direction essentially parallel to the plane of truncation or the plane of approximately the sensible horizon and impinges the cylindrical surface at the very edge of the truncation opposite the sun. In other words, during sunrise the ray of sunlight would impinge the western edge of the sundial, while during sunset the ray of sunlight would impinge the eastern edge of the truncation. Therefore, since the date lines are circumferentially projectable about the cylindrical surface to ultimately intersect the edge of the truncation 84, the concurrent intersection of a time line, whether actual or interpolated, with one of the date lines, again either actual or interpolated, at the edge of the truncation 84 provides an indication of the approximate time of sunrise or sunset.

As suggested in the foregoing discussion, the edges 84 of the truncation of the cylindrical surface 22 must be level. Concurrently, the axis of the cylindrical surface must be inclined to the horizontal at an angle equal to the latitude of the particular point of observation. Of course, the relation between the inclination of the cylindrical surface and the truncation thereof is normally fixed. Nonetheless, the problem remains that it may be difficult to arrange the sundial so that the edges 84 are horizontal and the cylindrical surface properly inclined. This may be particularly the case if the sundial is to be portable. As a solution to this problem, suitable leveling means are provided and are connected to the base to indicate when the base and thus the edges 84 of the truncation and the inclination of the longitudinal axis of the cylindrical surface are arranged in a proper configuration. Furthermore, suitable adjusting means are connected to the base to effect any necessary adjustment of the base to a level posture.

In the case of the embodiment illustrated in FIGS. 5(*a*) through 5(*e*), a suitable anchor bolt 86 and associated nut 88 are secured to any suitable monument and serve to anchor the sundial thereto. The anchor bolt 86 passes through an aperture 90 in the body portion of the sundial. An appropriate washer 92 is inserted over the anchor bolt after removing the arcuate retaining plate 62 and the cylindrical body 56. Thereafter, the nut 88 is threaded onto the bolt. Ultimately, the nut and washer will bear against the body portion 20 of the sundial to anchor the sundial to the monument. A number of leveling screws 94, preferably three in number, may be threaded through the body portion 20 of the sundial as illustrated in FIGS. 5(*a*) and 5(*c*). The heads 96 of these anchoring screws should bear against various portions of the monument to form essentially a tripod. Thus, by varying the extent to which the leveling screws protrude from the body portion 20 of the sundial, the sundial can be leveled. An indication of when the sundial is properly oriented can be given by conventional leveling vials containing a liquid and a bubble and configured as illustrated in FIGS. 9(*a*) and 9(*b*). One such vial 98 is provided for each direction in which the base of the sundial and thus the edges of the truncation or the plane thereof must be leveled. Alternatively, a circular bullseye vial of the type commonly used in surveying instruments may be centrally located and employed to indicate when the sundial is properly positioned. After leveling and anchoring the sundial, the cylindrical body 56 and arcuate retaining plate can be replaced.

The embodiment of the sundial illustrated in FIGS. 9(*a*) and 9(*b*) affords a somewhat different approach to leveling the sundial. This embodiment is intended to be readily portable. Thus, rather than an anchor bolt and separate leveling screws as in the embodiment of FIGS. 5(*a*) through 5(*e*), three legs 100 of variable length are provided. The three legs together form a tripod to support the sundial in a stable manner. Each leg carries a rounded bearing surface 102 intended to directly contact the surface on which the sundial rests. The remaining length of the leg is threaded as at 104 and passes through the base 18 of the sundial. By varying the extent to which each leg protrudes from the base 18, the sundial can be leveled using the leveling vials as described earlier or an inclinometer. The embodiment of the sundial illustrated in FIGS. 5(*a*) through 5(*e*) can be rendered portable by employing the legs 100 of FIGS. 9(*a*) and 9(*b*) threaded into apertures 106.

The sundial illustrated in FIGS. 9(*a*) and 9(*b*) also varies from those discussed earlier in that the gnomon 24 is not arcuate, but rather is straight. The important consideration is that the tip of the gnomon fall on the longitudinal axis of the cylindrical surface 22 of the sundial and in a plane essentially perpendicular to the longitudinal axis and intersecting the cylindrical surface at the line of zero declination of the sun on the sundial.

Sun Compass

In accordance with the present invention the sundial embodiments previously disclosed can be utilized to indicate a north-south direction when either the time or date is known. Moreover, in FIGS. 10 through 18 there is disclosed a portable sun compass which affords latitudinal and longitudinal adjustment of the dial face to compensate for time zone and latitude variances.

The apparatus of FIGS. 5(*a*) through 5(*e*) can, if the correct time of day is known, be utilized as a compass to indicate the nothern direction. That is, the base 18 and body 20 can be shifted until the tip of the gnomon casts a shadow which falls upon the surface 22 at a location corresponding to the the time of day. Since the time lines 47 inherently compensate for the difference between the Greenwich Hour Angle of noon Local Civil Time (also referred to as the difference between mean solar time and apparent solar time), the apparatus will be properly oriented such that the longitudinal axis 28 of the cylindrical surface and the polar axis of the earth together define a plane extending generally north and south through the earth. In other words, by sighting along a vertical plane defined by the tip of the gnomon and index markings on the arcuate plate 62 and on the lower front portion of body 20, the northern direction can be observed.

In similar fashion, the apparatus of FIGS. 8(*a*) through 9(*b*) can be utilized to provide a north-south indication.

Further versatility is afforded by the date lines 77 of the cylindrical surface 22 (FIG. 7(*a*)). In the event that the time of day is unknown the sun compass can be oriented to a north-south alignment by correlating the gnomon shadow on the proper month and day location on the cylindrical surface. It should be appreciated that when the sun compass is oriented so that the gnomon shadow indicates the time of day, it will by the very nature of the apparatus, also indicate the date and vice versa. However, the date lines serve to make available a means for orienting the sun compass in a true north-south direction when the time of day is unknown.

In FIGS. 10 through 18 there is depicted another form of sun compass 200 which is portable and which incorporates unique adjustability features. This sun compass includes a base 202 comprising a stationary portion 204 on which slidably sits a movable portion 206 (FIG. 13). The stationary portion includes a convex upper surface 208 which conforms to a concave undersurface 210 of the movable portion. The stationary and movable portions 204, 206 are held together by a flexible coupling element, such as a coil spring 212 for example. An opening 214 through the center of the stationary base portion receives the spring 212. At its lower end the spring is attached to a rod 216 which seats against a shoulder 218 of the stationary base portion. At its upper end the spring is attached to a rod 220 which seats against a shoulder 222 of the movable base portion. The rods 216, 220 thus maintain the spring 212 in operative engagement with the stationary movable base portions 204, 206. The upper end of the opening 214 includes a flared portion 224 which allows the movable portion 206 to slide along the convex surface 208.

A bracket 226 is rigidly connected to the movable base portion 206. This bracket 226 can carry one or more bubble levels 227 (FIG. 10) enabling the movable base portion to be leveled horizontally. A flange 228 is coupled to the bracket 226 by a screw 230. The flange 228 carries an upper base portion in the form of an upwardly open, lower hemisphere 232. The lower hemisphere 232 is preferably formed of a transparent material, such as plastic. The inner wall 234 of the hemisphere forms an inwardly concave hemispherical support wall which slidably carries a body 236. The body 236 has a lower convex face 238 which conforms to the shape of the concave support wall 234. First and second rows of pins 240, 241 are attached to the base hemisphere 232. The pins 240, 241 include heads 242, 243 which are received in internal channels 244, 245 formed in the body 236. These channels and pins form guide assemblies which guide the body in a given path of travel within the base hemisphere, i.e., from left to right in FIG. 13, such that the body 236 rotates about the center C of the hemispherical base portion.

Attached to the body is a generally U-shaped gnomon 250 which terminates in a pointed tip 252. This tip 252 is substantially coincident with the center C of the hemispherical base portion.

Slidably disposed on the body 236 is a cylindrical plate 254 which includes an open ended cylindrical surface 256. This surface 256 may be formed of a flexible sheet similar to that disclosed at 70 in FIG. 8(*a*). The sheet 258 includes time lines 260 which reflect built-in adjustment for the equation of time, as described previously. The sheet preferably includes declination lines 262 and a plurality of date lines (not shown) representing months and days of the year also as previously described. Moreover, as discussed previously in conjunction with FIGS. 7(*a*) through 7(*d*), different sheets may be employed for different seasons of the year.

The longitudinal axis of the cylindrical surface 256, depicted at R in FIG. 13, is arranged to intersect the center C of the base hemisphere, and thus also intersect the tip 252 of the gnomon 250.

The slidable plate 254 includes a pair of rows of pins 270, 271 which project into the body. These pins include heads which are slidably received with guide channels formed in the body 236 to guide the plate for sliding movement in the manner of pins 240, 241. The movement which is guided by the pins 270, 271 is directed in a second path of travel extending generally perpendicularly to the path of travel guided by the guide pins 240, 241, i.e., in a direction perpendicular to the plane of the paper in FIG. 13, such that the plate 254 rotates about the axis R. As will be discussed, movement guided by the pins 240, 241 serves as a latitude adjustment, while movement guided by the pins 270, 271 serves as longitudinal adjustment.

As previously discussed, the location at which readings are to be taken may not coincide with the standard meridian of the time zone in which that location is found. Thus, it is desirable to collectively shift the time lines by four minutes of time per every degree of longitude that the meridian of observation is to one side (i.e., east or west), of the standard meridian.

It will also be western that in use, the longitudinal axis of the cylindrical surface must be oriented parallel to the north-south pole 40 of the earth (FIG. 3), resulting in the formation of an angle $\gamma$ between the longitudinal axis R and a plane tangent to the earth's surface. This angle $\gamma$ is equal to the latitude of the point of observation.

The preferred portable sun cmpass of the present invention provides a unique adjustment for longitude and latitude wherein the body 236 and/or the plate 254 are shifted within the base hemisphere 232 to properly adjust for longitudinal and latitudinal conditions.

In this connection, a control mechanism 280 is provided (see FIGS. 13 and 16 through 18). The control mechanism includes a hollow outer housing 282 which is secured to the base hemisphere 232. The housing includes a slot 284 and indicia scale 286 for reasons to be discussed.

Within the housing there is mounted a tube 288 (FIG. 17). The tube includes an annular bearing flange 290 at the front end thereof. The flange 290 is rotatably mounted in a slot 292 of a thrust bearing block 294 which is coupled to the housing 282. At the rear end of the tube, there are carried a pair of arms 196 which extend radially outwardly from the tube. Mounted to the outer ends of the arms 296 is an annular bearing ring 298 which is rotatable against the inner surface 300 of the housing. It is thus apparent that the tbe 288 is rotatable within the housing, while being held therein against axial displacement by the thrust bearing block 294. Disposed around the exterior of the tube 288 is an outer end of an elongate coil spring 310. The arrangement is such that the arms 296 extend between and through the helical coils of the spring. Consequently, turning motion of the tube 288 and arms 296 about the longitudinal axis of the tube will translate the coil spring axially along the tube, due to travel of the arms around the helically or spirally arranged coils of the spring.

A knob 312 is secured to the tube 288 and is disposed externally of the housing 282. Rotation of this knob 312 produces rotation of the tube 288 and arms 296 to translate the spring relative to the housing.

The inner end of the spring 310 is anchored to the body 236 (FIGS. 10 and 13) by any suitable anchoring means. As a result, axial translation of the coil spring produces movement of the body along the rows of guide pins 240, 241 (i.e., from left to right and vice versa in FIG. 13). In so doing, the convex surface 238 of the body slides along the concave surface 234 of the base hemisphere about the center C of the base hemisphere so as to alter the inclination of the axis R of the cylindrical surface 256. Such movement effects a latitudinal adjustment of the indicia sheet 258. Due to the cooperative hemispherical profiles of the body 236 and hemisphere 232, the axis R and the tip 252 of the gnomon continue to lie on the center C of the base hemisphere.

The spring 310, at its inner end disposed within the housing 282, defines a pointer 314 which travels within the slot 284 formed in the housing. This pointer 314 is visible from outside so that the latitudinal position of the body 236 can be easily read on the scale 286. For example, the scale 286 can be calibrated in terms of degrees. A fine-tuning scale 287 can be provided on the knob 312 (FIG. 18*e*) and calibrated in minutes to provide a finer control of the adjustment.

A longitudinal adjustment mechanism is coaxially disposed within the latitudinal adjustment mechanism. In this connection, a shaft 320 is situated within the tube 288. The shaft 320 includes an outer projection 322 which extends through an aperture 324 in the latitudinal control knob 312. A longitudinal control knob 326 is coupled to the projection 322 by a screw 327. A washer 328 cooperates with the knob 326 to prevent appreciable axial displacement of the shaft relative to the housing 282.

Another elongate coil spring 330 is disposed within outer coil spring 310. This inner spring 330 is secured at its outer end to a block 332 which is slidably mounted on the shaft 320.

The shaft 320 has a non-rounded circumference, shown as rectangular in the preferred embodiment (FIG. 18*c*). The block 332 has a central aperture 334 which is complementarily shaped. Thus, the block 332 and coil spring 330 can slide relative to the shaft 320, but must rotate therewith.

Attention is directed to FIGS. 13 and 15 wherein it is demonstrated that the inner end of the inner coil spring 330 extends beyond the terminus of the outer spring 310. The inner spring 330 is anchored to an axle 340 of a drive gear 342. The drive gear 342 is rotatably mounted to the body 236 by a pair of bearing brackets 344. The drive gear is part of a drive assembly 346 which is disposed within an inner cavity 348 of the body 236.

Meshingly engaging the drive gear 342 is a pinion gear 350 which is rotatably mounted within the cavity 348 upon an axle 352. The pinion 350 meshes with a curved toothed rack 354 which is secured to the outer convex surface 238 of the plate 254. Rotation of the longitudinal knob 326 thus rotates the shaft 320, the coil spring 330, and the gears 342, 350 to rotate the plate 254 about its axis R and thereby adjust the longitudinal position of the cylindrical plate 254. This motion is guided by the guide pins 270,271.

A pointer 360 is mounted on the body 236 adjacent the gnomon 250 and overlies a portion of the cylindrical face 256. A scale (not shown) can be inscribed on the face so that the pointer 360 will provide an indication of the longitudinal adjustment of the plate 254.

It will be realized that latitudinal adjustment of the body 236 by the outer spring 310 is accommodated by the slidable relationship between the inner spring 330 and the shaft 320 to avoid longitudinal deviation of the plate 254.

A top, or upper hemisphere 370 is mounted on the base hemisphere 232 to form a closed spherical housing. This upper hemisphere like the lower hemisphere, is fabricated of transparent material. The upper hemisphere 370 has inscribed thereon a semi-circular arc 372 which cooperates with an azimuth scale 374 inscribed around the upper periphery of the base hemisphere 232 (see FIGS. 10 and 14). The azimuth scale is calibrated in degrees from 0° to 360° such that an imaginary reference plane bisecting the cylindrical plate 254 in a longitudinal direction will bisect the 0° (360°) and 180° positions.

The top hemisphere 370 is rotatably mounted on the base hemisphere 232. As depicted in FIG. 12, the upper hemisphere includes an inner toothed rack 376 which can be integrally formed with the upper hemisphere, or can comprise a separate member secured thereto. A control gear 378 has an axle carried by the base hemisphere. A knob 384 is affixed to the axle 380 and is accessible from outside the spherical housing to rotate the control gear 378. A spring 385 biases the knob 384 outwardly. The control gear 378 is meshingly engaged with the rack 376 such that rotation of the knob 384 reorients the arc 372 relative to the azimuth scale 374. Two diametrically opposed retaining springs 386 (one shown in FIG. 11) are mounted to the base hemisphere and each has an upper leg 388 biased toward engagement with the top of the rack 376 so as to frictionally retain the uper hemisphere from unintentional movement. The retaining spring 386 can be manually released by manual depression of a release button 390 that is mounted to the retaining sring 386 and projects through a hole 392 in the 390 base hemisphere.

Rapid positioning of the upper hemisphere 370 can be performed by pressing the knob 384 inwardly to disengage the gear 378 from the rack 376. Subsequent re-engagement of the gear 378 and rack 376 will be produced by the spring 385.

An altitude scale 396 can be inscribed on the top hemisphere 370 adjacent the arc 372 and calibrated from 0° to 90° for reasons to be discussed subsequently.

Embodiments of the invention are disclosed in FIGS. 19, 20, and 21 wherein the plate which carries the dial face is in the form of a double-walled cylindrical plate 400. This plate 400 includes inner and outer walls 402, 404 which are each preferably of truncated cylindrical shape, although they could be completely annular if desired. The walls 402, 404 are formed of any suitably transparent material. The innermost wall 402 carries time, declination and date lines in suitable fashion on the face inside of the chamber. The outermost wall 404 is radially spaced from the inner wall to define a chamber 406 therebetween. Filler strips 408 can be provided between the peripheries of the inner and outer walls 402, 404 to enclose the chamber 406. Situated within the chamber is an opaque cling-free liquid 408. The liquid 408 could, for example, comprise a white or silver cling-free liquid such as mercury or dyed alcohol. The remainder of the chamber preferably contains an inert gas to reduce the effects of moisture in the chamber.

Figure 5A:
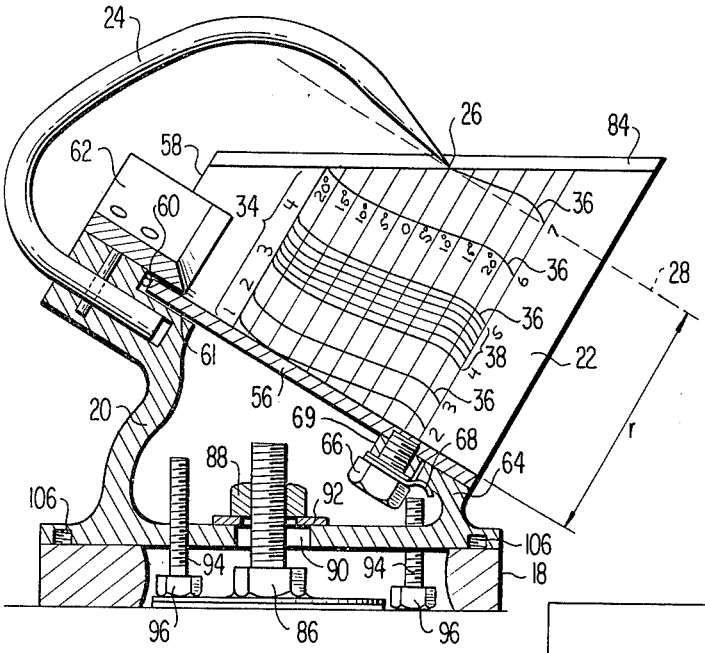
Figure 5B:
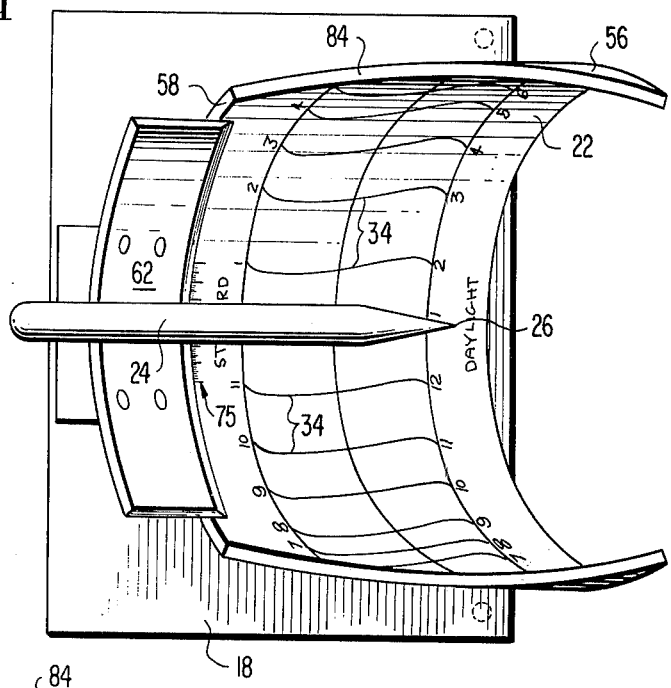
Figure 5C:
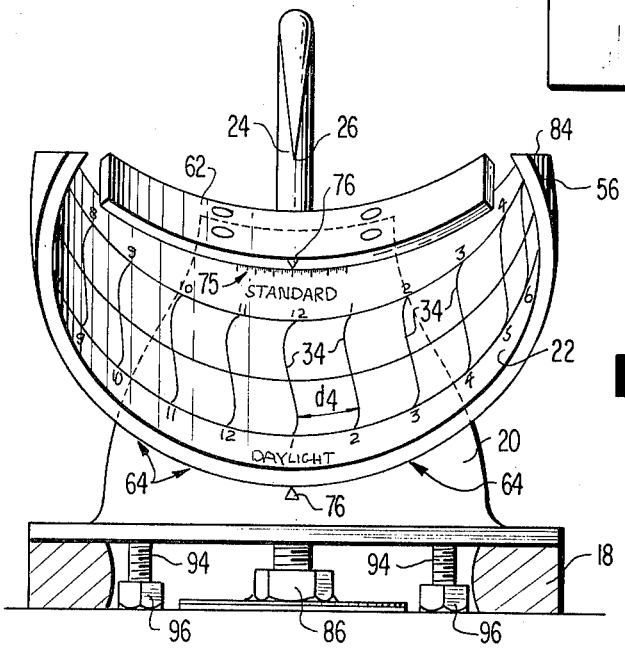
Figure 5D:
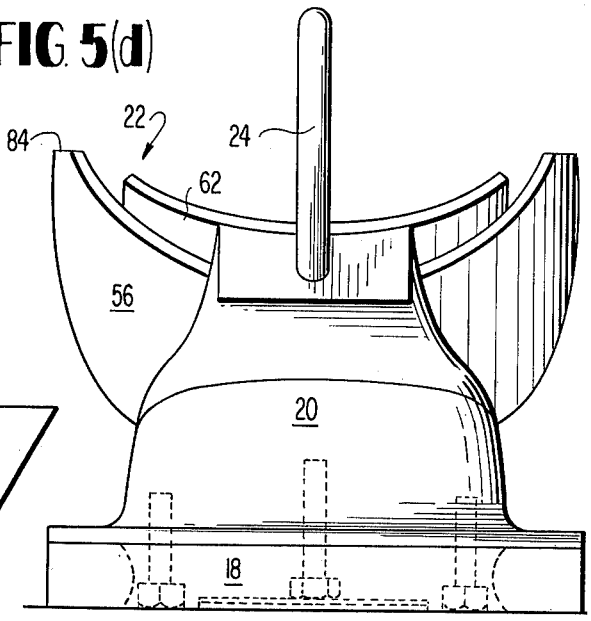
Figure 5E:
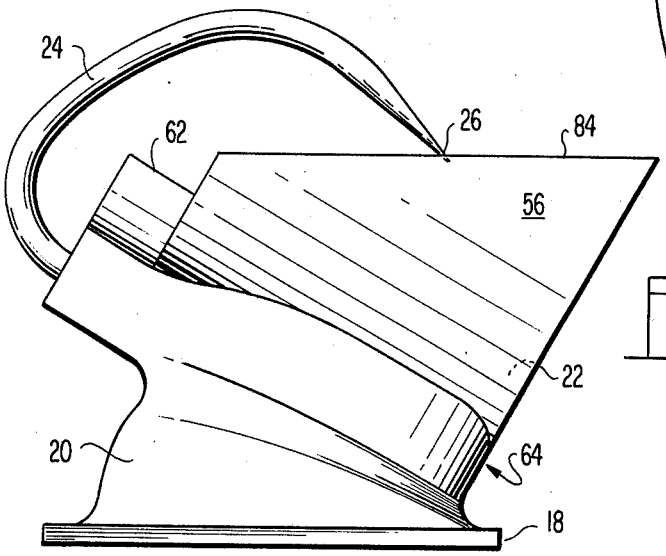

The liquid automatically assumes a position within the chamber wherein its upper level serves to truncate the plate much in the same manner as the aforementioned edge 84 described in conjunction with FIGs. 5A–5C. By employing liquid in a quantity to correspond with the sensible horizon at the equator, the sensible horizon would continue to be indicated (due to symmetry) as the cylinder is tilted for other latitudes within the equivolume limits of the symmetrical portions of the chamber.

A truncated form of the double-walled cylinder of FIG. 19 is depicted in FIG. 21. It may be noted that the dial face thus produced would automatically adjust to an ideal configuration for the display of a proper shadow for readings at all sunlight hours at any latitude from 0° to 67°, and at the same time provide a sufficient open-sight to avoid the necessity of reading the instrument through the reverse side of the time and declination lines on the transparent cylinder.

FIG. 19 shows such a cylinder without truncation which may be used at any latitude, but is especially suited to the polar latitudes. As illustrated, the cylinder is inclined for use at 75° latitude. FIG. 20 shows the liquid level and resulting dial face configuration for a 90° latitude (at pole).

Operation of Sun Compass

In operation, the longitudinal adjustment knob 326 is rotated so as to rotate gears 342, 350 and shift the plate 254 relative to the body 236 to compensate for the difference in longitude between the point of observation and the standard meridian for the time zone containing the point of observation. This adjustment is made at the rate of four minutes of time per degree of difference. The pointer 360 is viewed to assure accurate adjustment along the direct-reading longitude scale.

The latitudinal adjustment knob 312 is rotated to displace the spring 310 and position the body in a proper orientation in accordance with the latitude of the place of measurement. The pointer 314 is viewed for accurate adjustment during this procedure.

The movable base portion 206 is then shifted on the stationary base portion 204 until properly leveled. The sun compass is then rotated on its vertical axis until the shadow made by the sun and gnomon 250 indicates on the appropriate half of the dial face 258 (AM or PM) the time of day or declination corresponding with the date of the year on the sheet 258. At this point, the arc 372 on the cover 370, if positioned to intersect the 0° and 180° points on the scale 374, will extend in a north-south direction. That is, the longitudinal axis R and the polar axis of the earth together define a plane extending north and south through the earth.

The cover can then be rotated by actuation of the knob 384 to direct the arc 372 at the adjacent object. By viewing the scale 374, the bearing of that object can be determined.

In addition, the scale 396 on the transparent cover can be employed to provide a reading of the sun's altitude. In this connection, one can sight until the tip of the gnomon is aligned with a point on the dial face 258 which defines a certain time and declination (or date). By turning the cover until the plane of the arc 372 passes through the line of sight just established, the corresponding altitude of the sun can be read on scale 396 and the sun's azimuth can be read on scale 374. This procedure can be used to predetermine the sun's altitude and azimuth for any remote latitude, longitude, declination (or date) and time of day for which the observer may select. It may be noted that this procedure does not require any shadow or that the instrument be level for this determination.

It will be realized that the disclosed sun compass will be suitable for use in all regions between the equator and polar zones. Of course, in certain regions, the orientation of the cylinder plate relative to the sun might be such as to inhibit the transfer of sufficient light to the sheet 254. For example, in a polar zone where the axis R is essentially vertically disposed, it would be advantageous to provide a cylindrical plate of transparent material and to overlap a portion of the plate relative to the body 236 to enhance the transmission of light, much in the manner of FIG. 19.

The sun compass of the present invention is highly accurate as well as being simple to use. A true north-south direction can be easily determined by knowing either the time of day or data of the year. This information can be used to determine direction when no other means for so doing is available, or to calibrate or compensate magnetic compasses or check other compasses.

The device lends itself to the substitution of various dial faces to accommodate all sunlight hours in a particular locale.

The transparent hemispherical casing portions provide protection for the parts while allowing a reading of the time sheet. Thus, the device is safely portable. Moreover, the unique adjustment mechanism is simple and yet effective to provide highly accurate adjustment.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A manually portable sun compass comprising: a base including an inwardly concave support surface; a body having a convexly shaped outer wall mounted for movement on said concave support surface;

a curved plate defining a cylindrical surface of fixed radius r mounted on said body;

a gnomon connected to said body, the tip thereof substantially coinciding with a longitudinal axis of said cylindrical surface and casting a shadow on said cylindrical surface dependent upon the hour angle and declination of the sun;

a plurality of generally parallel equally spaced time lines designating the hours of the day, said time lines being disposed on said plate and extending generally longitudinally of the longitudinal axis of said plate;

said time lines vary from time lines strictly parallel to said longitudinal axis by a distance $d_2$ defined by the equation $$d_2 = (r \pi \alpha) / 180°$$

wherein $\alpha$ is the algebraic difference between the Greenwich Hour Angle of the sun and the Greenwich Hour Angle of noon Local Civil Time;

a plurality of data lines being disposed on said plate, said data lines being spaced by distances which define ranges of declination of the sun and which indicate the month of the year;

the tip of said gnomon casting a shadow which, upon falling on or between said time lines at a location corresponding to the time of day, and on or between said date lines at a location corresponding to the date, indicates that the longitudinal axis of said cylindrical surface and the polar axis of the earth together define a plane extending essentially north and south through the earth;

first guide means, on one of said body and said base and engaging the other thereof, for restraining said body for movement in a first arcuate path relative to said base;

second guide means, on one of said plate and said body and engaging the other thereof, for restraining said plate for movement in a second arcuate path relative to said body;

first adjusting means for rotating said body along said first arcuate path on said concave support surface to adjust the position of said date lines, said first adjusting means comprising:

a first actuating member disposed externally of said concave support surface, a first drive mechanism interconnecting said first actuating member and said body for displacing said body along said first path in response to movement of said first actuating member, and a first scale disposed adjacent said first actuating member and externally of said concave support surface for indicating the amount of displacement of said body along said first arcuate path, and second adjusting means for shifting said plate along said second arcuate path relative to said body to adjust the positioon of said time lines, said second adjusting means comprising:

a second actuating member disposed externally of said concave support surface;

a second drive mechanism interconnecting said second actuating member and said plate for displacing said plate along said second arcuate path in response to movement of said second actuating member, and a second scale disposed adjacent said second actuating member and externally of said concave support surface for indicating the amount of displacement of said plate along said second arcuate path.

2. Apparatus according to claim 1 wherein said first adjusting means comprises a first elongated flexible member coupled to said body; first actuating means, including a manually rotatable first knob, for displacing said elongated flexible member to slidably shift said body on said support surface; said second adjusting means comprising a second elongated flexible member extending within said first flexible member; second actuating means, including a manually rotatable second knob, for rotating said second flexible member; and rotation transmitting means operably connected to said second flexible member and said plate to transmit rotary motion of said second flexible member to said plate to slidably shift said plate on said body.

3. Apparatus according to claim 2 including a housing attached to said base; said first flexible member comprising a first coil spring; means connected to said first knob and extending through coils of said coil spring such that rotation of said knob produces displacement of said first coil spring; said first coil spring having an indicator slidable in a scaled slot in said housing; said second flexible member comprising a second coil spring situated within said first coil spring; said rotation transmitting means comprising gear means; and a toothed rack being mounted on said plate and meshingly engaging said gear means.

4. Apparatus according to claim 3 wherein said second adjusting means includes a non-circular shaft; said second coil spring having a block attached at an outer end thereof; said block being slidably mounted on said shaft in a manner excluding rotation relative to said shaft.

5. A manually portable sun-actuated instrument comprising:

a base including a hemispherical base member, said member presenting a hemispherical support surface;

a body including a curved bottom wall corresponding to the shape of said support surface and seated thereon;

a plate being mounted for movement on said body, said plate including a cylindrically curved face of fixed radius;

a plurality of generally parallel equally spaced time lines designating the hours of the day, said time lines being disposed on said face and extending generally longitudinally of the longitudinal axis of said face;

a gnomon connected to said body and having a tip substantially coinciding with the center of said hemispherical member and cylindrical a shadow on said cylindrical face dependent upon the hour angle and declination of the sun;

the tip of said gnomon casting a shadow which, upon falling on or between said time lines at a location corresponding to the time of day indicates that the longitudinal axis of said plate and the polar axis of the earth together define a plane extending essentially north and south through the earth;

first guide means, on one of said body and said plate and engaging the other thereof, for guiding said plate for movement in a first predetermined path along said body;

second guide means, on one of said body and said base member and engaging the other thereof, for guiding said body for movement in a second predetermined path on said hemispherical support surface;

first adjusting means manually accessible externally of said hemispherical base member and operatively connected to said body to shift said body along said second path to adjust the latitudinal position of said plate;

second adjusting means manually accessible externally of said hemispherical base member and operatively connected to shift said plate along said first path to adjust the longitudinal position of said plate;

a transparent hemispherical top rotatably mounted on said hemispherical base member, said transparent top having an arc line which bisects said top, the ends of which arc intersect a 360 degree indicia scale situated around the upper edge of said hemispherical base member at points spaced 180° apart.

6. Apparatus according to claim 5 wherein said base member is transparent; said first adjusting means comprising a first elongated flexible member coupled to said body; first actuating means, including a manually rotatable first knob, for displacing said elongated flexible member to slidably shift said body on said support surface, said second adjusting means comprising a second elongated flexible member extending within said first flexible member; second actuating means, including a manually rotatable second knob, for rotating said second flexible member; and rotation transmitting means operably connected to said second flexible member and said plate to transmit rotary motion of said second flexible member to said plate to slidably shift said plate on said body.

7. Apparatus according to claim 6 including a housing attached to said base; said first flexible member comprising a first coil spring; means connected to said first knob and extending through coils of said coil spring such that rotation of said knob produces displacement of said first coil spring; said first coil spring having an indicator slidable in a scaled slot in said housing; said second flexible member comprising a second coil spring situated within said first coil spring; said rotation transmitting means comprising gear means; and a toothed rack being mounted on said plate and meshingly engaging said gear means.

8. Apparatus according to claim 7 wherein said second adjusting means includes a non-circular shaft; said second coil spring having a block attached at an outer end thereof; said block being slidably mounted on said shaft in a manner excluding rotation relative to said shaft.

9. Apparatus according to claim 5 wherein said base includes a stationary section including a convex outer surface, and a movable section having a concave surface slidably mounted on said convex surface; said hemispherical base member being transparent and carried by said movable base portion; and bubble level means carried by said movable base section for indicating when said movable base portion is horizontally oriented.

10. Apparatus according to claim 5 wherein said arc line on said transparent top is calibrated to afford a reading of the altitude of the sun.

11. A manually portable sun-actuated instrument comprising:

a base including a hemispherical base member, said member presenting a hemispherical support surface;

a body including a curved bottom wall corresponding to the shape of said support surface and seated thereon;

a plate being mounted for movement on said body, said plate including a cylindrically curved face of fixed radius, a plurality of generally parallel equally spaced time lines designating the hours of the day, said time lines being disposed on said face and extending generally longitudinally of the longitudinal axis of said face;

a gnomon connected to said body and having a tip substantially coinciding with the center of said hemispherical member and casting a shadow on said cylindrical face dependent upon the hour angle and declination of the sum;

the tip of said gnomon casting a shadow which, upon falling on or between said time lines at a location corresponding to the time of day indicates that the longitudinal axis of said plate and the polar axis of the earth together define a plane extending essentially north and south through the earth;

first guide means, on one of said plate and said body and engaging the other thereof, for guiding said plate for movement in a first predetermined path along said body;

second guide means, on one of said body and said base member and engaging the other thereof, for guiding said body for movement in a second predetermined path on said hemispherical support surface;

first adjusting means manually acessible externally of said hemispherical base member and including a first elongate portion extending into said base member and operatively connected to said body to shift said body along said second path to adjust the latitudinal position of said plate; and second adjusting means being manually accessible externally of said hemispherical base member and including a second elongate portion extending into said base member co-axially relative to said first elongate portion, said second elongate portion being operatively connected to said plate to shift said plate along said first path to adjust the longitudinal position of said plate.

12. A manually portable sun-actuated instrument comprising:

a body;

a cylindrical plate mounted on said body, said plate including a pair of cylindrical, mutually spaced inner and outer walls formed of transparent material and defining a chamber therebetween;

said chamber being partially filled with a quantity of opaque, essentially cling-free liquid;

a plurality of time lines designating the hours of the day, said time lines being disposed on one of said walls; and a gnomon connected to said body and having a tip substantially coinciding with the center of said cylindrical plate and casting a shadow on said cylindrical plate dependent upon the hour angle and declination of the sun;

the tip of said gnomon casting a shadow which, upon falling on or between said time lines at a location corresponding to the time of day indicates that the longitudinal axis of said plate and the polar axis of the earth together define a plane extending essentially north and south through the earth.

13. An instrument according to claim 12 and further comprising: a hemispherical base upon which said body is mounted for movement; first guide means, on one of said plate and said body and engaging the other thereof, for guiding said plate for movement in a first predetermined path along said body; second guide means, on one of said body and said base and engaging the other thereof, for guiding said body for movement in a second predetermined path on said base; first adjusting means manually accessible externally of said hemispherical base and operatively connected to said body to shift said body along said second path to adjust the latitudinal position of said plate; and second adjusting means manually accessible externally of said hemispherical base and operatively connected to said plate to shift said plate along said first path to adjust the longitudinal position of said plate.

14. Apparatus according to claim 13 wherein said base comprises a transparent hemispherical member, and further including a transparent hemispherical top rotatably mounted on said hemispherical base member, said transparent top havig an arc line which bisects said top, the ends of which arc intersect a 360° indicia scale situated around the upper edge of said hemispherical base member at points spaced 180° apart.

15. Apparatus according to claim 12 wherein said time lines and also date lines are disposed on a surface of said inner wall which faces said chamber; the quantity of liquid in said chamber being such that, when the axis of the plate is parallel to the earth's axis, the level of said liquid simulates the horizon whereby the intersection of an appropriate date line and said liquid level determines the times of sunrise and sunset.

16. A manually portable sun compass comprising:

a base including an inwardly concave support surface;

a body having a convexly shaped outer wall mounted for movement on said concave support surface, a curved plate of fixed radius r mounted on said body;

a gnomon connected to said body, the tip thereof substantially coinciding with a longitudinal axis of said cylindrical surface and a shadow on said cylindrical surface dependent upon the hour angle and declination of the sun;

a plurality of generally parallel equally spaced lines designating the hours of the day, said time lines being disposed on said plate and extending generally longitudinally of the longitudinal axis of said plate;

said time lines vary from time strictly parallel to said longitudinal axis by a distance $d_2$ defined by the equation $$d_2 = (r\ \pi\ \alpha)/180°$$

wherein $\alpha$ is the algebraic difference between the Greenwich Hour Angle of the sun and the Greenwich Hour Angle of noon Local Civil Time;

a plurality of data lines being disposed on said plate, said date lines being spaced by distances which define ranges of declination of the sun and which indicate the month of the year;

the tip of said gnomon casting a shadow which, upon falling on or between said time line at a location corresponding to the time of day, and on or between said date lines at a location corresponding to the date, indicates that the longitudinal axis of said cylindrical surface and the polar axis of the earth together define a plane extending essentially north and south through the earth;

first adjusting means for rotating said body in an arcuate path on said support surface to adjust the position of said date lines, said first adjusting means comprising:

a first elongated flexible member coupled to said body, and first actuating means, including a manually rotatable first knob, for displacing said elongated flexible member to slidably shift said body on said support surface;

second adjusting means for shifting said plate in an arcuate path relative to said body to adjust the position of said time lines, said second adjusting means comprising:

a second elongated flexible member extending within said first flexible member;

second actuating means, including a manually rotatable second knob, for rotating said second flexible member; and rotation transmitting means operably connected to said second flexible member and said plate to transmit rotary motion of said second flexible member to said plate to slidably shift said plate on said body.

* * * * *